US010679638B2

(12) United States Patent
Markovic et al.

(10) Patent No.: US 10,679,638 B2
(45) Date of Patent: *Jun. 9, 2020

(54) HARMONICITY-DEPENDENT CONTROLLING OF A HARMONIC FILTER TOOL

(71) Applicant: Fraunhofer-Gesellschaft zur Foerderung der angewandten Forschung e.V., Munich (DE)

(72) Inventors: Goran Markovic, Nuremberg (DE); Christian Helmrich, Berlin (DE); Emmanuel Ravelli, Erlangen (DE); Manuel Jander, Hemhofen (DE); Stefan Doehla, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/118,316

(22) Filed: Aug. 30, 2018

(65) Prior Publication Data

US 2019/0057710 A1 Feb. 21, 2019

Related U.S. Application Data

(60) Division of application No. 15/411,662, filed on Jan. 20, 2017, now Pat. No. 10,083,706, which is a (Continued)

(30) Foreign Application Priority Data

Jul. 28, 2014 (EP) ..... 14178810

(51) Int. Cl.
*G10L 19/00* (2013.01)
*G10L 19/26* (2013.01)
(Continued)

(52) U.S. Cl.
CPC ..... *G10L 19/265* (2013.01); *G10L 19/025* (2013.01); *G10L 19/028* (2013.01);
(Continued)

(58) Field of Classification Search
CPC ..... G10L 19/20; G10L 19/26; G10L 21/02
(Continued)

(56) References Cited

U.S. PATENT DOCUMENTS 5,012,517 A 4/1991 Wilson et al.
5,469,087 A 11/1995 Eatwell
(Continued)

FOREIGN PATENT DOCUMENTS

EP 2226794 A1 9/2010
KR 10-2017-7005451 A1 10/2018
RU 2376657 C2 12/2009

OTHER PUBLICATIONS

Chen, et al., "Adaptive postfiltering for quality enhancement of coded speech", IEEE Transactions on Speech and Audio Processing, vol. 3, No. 1, Jan. 1995, pp. 59-71.
(Continued)

*Primary Examiner* — Daniel Abebe
(74) *Attorney, Agent, or Firm* — Michael A. Glenn; Perkins Coie LLP

(57) ABSTRACT

The coding efficiency of an audio codec using a controllable—switchable or even adjustable—harmonic filter tool is improved by performing the harmonicity-dependent controlling of this tool using a temporal structure measure in addition to a measure of harmonicity in order to control the harmonic filter tool. In particular, the temporal structure of the audio signal is evaluated in a manner which depends on the pitch. This enables to achieve a situation-adapted control of the harmonic filter tool so that in situations where a control made solely based on the measure of harmonicity
(Continued)

would decide against or reduce the usage of this tool, although using the harmonic filter tool would, in that situation, increase the coding efficiency, the harmonic filter tool is applied, while in other situations where the harmonic filter tool may be inefficient or even destructive, the control reduces the appliance of the harmonic filter tool appropriately.

27 Claims, 20 Drawing Sheets

Related U.S. Application Data continuation of application No. PCT/EP2015/067160, filed on Jul. 27, 2015.

(51) Int. Cl.

| | |
|---|---|
| ***G10L 19/025*** | (2013.01) |
| ***G10L 19/028*** | (2013.01) |
| ***G10L 19/12*** | (2013.01) |
| ***G10L 19/22*** | (2013.01) |
| ***G10L 25/21*** | (2013.01) |
| ***G10L 25/90*** | (2013.01) |

(52) U.S. Cl.
CPC ..... *G10L 19/12* (2013.01); *G10L 19/22* (2013.01); *G10L 19/26* (2013.01); *G10L 25/21* (2013.01); *G10L 25/90* (2013.01)

(58) Field of Classification Search
USPC ..... 704/205
See application file for complete search history.

(56) References Cited

U.S. PATENT DOCUMENTS

| | | | | |
|---|---|---|---|---|
| 5,857,168 | A * | 1/1999 | Ozawa | G10L 19/0208 704/219 |
| 5,963,895 | A | 10/1999 | Taori et al. | |
| 6,691,092 | B1 * | 2/2004 | Udaya Bhaskar | G10L 19/097 704/205 |
| 6,826,525 | B2 | 11/2004 | Hilpert et al. | |
| 7,529,660 | B2 | 5/2009 | Lefebvre et al. | |
| 7,546,240 | B2 | 6/2009 | Mehrotra et al. | |
| 8,069,040 | B2 | 11/2011 | Koen | |
| 8,095,359 | B2 | 1/2012 | Boehm et al. | |
| 8,738,385 | B2 | 5/2014 | Chen | |
| 2004/0181403 | A1 | 9/2004 | Hsu | |
| 2005/0143979 | A1 | 6/2005 | Lee et al. | |
| 2009/0018824 | A1 | 1/2009 | Teo | |
| 2011/0282656 | A1 | 11/2011 | Grancharov et al. | |
| 2012/0101824 | A1 | 4/2012 | Chen | |

OTHER PUBLICATIONS

Fastl, et al., "Psychoacoustics: Facts and Models", 3rd Edition; Springer, Dec. 14, 2006, 201 pages.
Fuchs, "Improving MPEG Audio Coding by Backward Adaptive Linear Stereo Prediction", 99th AES Convention; New York, 28 pages, Oct. 6-9, 1995.
ITU-T, G.729, "Coding of Speech at 8 kbit/s Using Conjugate-Structure Algebraic-Code-Excited Linear Prediction (CS-ACELP)", Series G: Transmission Systems and Media, Digital Systems and Networks, Recommendation ITU-T G.729, Telecommunication Standardization Sector of ITU, Jun. 2012, 152 pages.
ITU-T; G.718, "Frame error robust narrow-band and wideband embedded variable bit-rate coding of speech and audio from 8-32 kbit/s", Recommendation ITU-T G.718, Telecommunication Standardization Sector of ITU, Jun. 2008, 257 pages.
Ojanperä, et al., "Long Term Predictor for Transform Domain Perceptual Audio Coding", 107th AES Convention; New York, Sep. 24-27, 1999, 26 pages.
Song, J. et al., "Harmonic Enhancement in Low Bitrate Audio Coding Using an Efficient Long-Term Predictor", EURASIP Journal on Advances in Signal Processing, Aug. 2010, pp. 1-9.
Valin, JM et al., "Definition of the Opus Audio Codec", IETF, Sep. 2012, pp. 1-326.
Villavicencio, F. et al., "Improving Lpc Spectral Envelope Extraction of Voiced Speech by True-Envelope Estimation", Acoustics, Speech and Signal Processing, 2006; 2006 IEEE International Conference on ICASSP 2006 Proceedings; Toulouse, France, May 14-19, 2006, pp. I-869-I-872.
Yin, et al., "A New Backward Predictor for MPEG Audio Coding", 103rd AES Convention; New York, Sep. 26-29, 1997, 13 pages.
Valin, et al., "High-Quality, Low-Delay Music Coding in the Opus Codec", 135th Convention, New York, 10 pages, Oct. 17-20, 2013.
Resch, et al., "Finalization of CE on an Improved Bass-Post Filter Operation for the ACELP of USAC", International Organisation for Standardisation ISO/IEC JTC1/SC29/WG11, Coding of Moving Pictures and Audio, MPEG2010/m18379, Oct. 2010, 13 pages.
3GPP TS 26.447, "Codec for Enhanced Voice Services; Error Concealment of Lost Packets", ETSI TS 126 447 V12.0.0, Oct. 2014, pp. 1-80.
ISO/IEC FDIS 23003-3:2011(E), "Information technology—MPEG audio technologies—Part 3: Unified speech and audio coding", ISO/IEC JTC 1/SC 29/WG 11 (Part 1 of 6), Sep. 20, 2011, pp. 1-291.
Resch, Barbara et al., "Finalization of CE on an improved bass-post filter operation for the ACELP of USAC", International Organization for Standardisation ISO/IEC JTC1/SC29/WG11, Coding of Moving Pictures and Audio, MPEG2010/m18379, Guangzhou Oct. 2010, pp. 1-13.
Valin, Jean-Marc et al., "High-Quality, Low-Delay Music Coding in the Opus Codec", 135th AES Convention, Oct. 17, 2013, Oct. 17, 2013, pp. 1-10.

* cited by examiner

```
enableLTP =

(bitrate< b1 && tcxMode==TCX_20 && (norm_corr(curr) * norm_corr(prev)) > 0.25 && tempFlatness < 3.5) ||

(bitrate>=b1 && tcxMode==TCX_10 && max(norm_corr(curr),norm_corr(prev)) > 0.5 && maxEnergyChange<3.5) ||

(bitrate>=b1 && norm_corr(curr) > 0.44 && norm_corr(curr) > 1.2-T_int/L) ||

(bitrate>=b1 && tcxMode==TCX_20 && (norm_corr(curr) > 0.44 &&

        (tempFlatness < 6.0 || (tempFlatness < 7.0 && maxEnergyChange < 22.0)));
```

FIG 2

HARMONICITY-DEPENDENT CONTROLLING OF A HARMONIC FILTER TOOL

CROSS-REFERENCE TO RELATED APPLICATION

This application is a divisional of U.S. patent application Ser. No. 15/411,662 filed Jan. 20, 2017, which is a continuation of International Application No. PCT/EP2015/067160, filed Jul. 27, 2015, which claims priority from European Application No. EP 14178810.9, filed Jul. 28, 2014, which are each incorporated herein in its entirety by this reference thereto.

The present application is concerned with the decision on controlling of a harmonic filter tool such as of the pre/post filter or post-filter only approach. Such tool is, for example, applicable to MPEG-D unified speech and audio coding (USAC) and the upcoming 3GPP EVS codec.

BACKGROUND OF THE INVENTION

Transform-based audio codecs like AAC, MP3, or TCX generally introduce inter-harmonic quantization noise when processing harmonic audio signals, particularly at low bitrates.

This effect is further worsened when the transform-based audio codec operates at low delay, due to the worse frequency resolution and/or selectivity introduced by a shorter transform size and/or a worse window frequency response.

This inter-harmonic noise is generally perceived as a very annoying "warbling" artifact, which significantly reduces the performance of the transform-based audio codec when subjectively evaluated on highly tonal audio material like some music or voiced speech.

A common solution to this problem is to employ prediction-based techniques, prediction using autoregressive (AR) modeling based on the addition or subtraction of past input or decoded samples, either in the transform-domain or in the time-domain.

However, using such techniques in signals with changing temporal structure again leads to unwanted effects such as temporal smearing of percussive musical events or speech plosives or even the creation of impulse trails due to the repetition of a single impulse-like transient. Thus, special care has to be taken for signals that contain both transient and harmonic components or for signals where there is ambiguity between transients and trains of pulses (the latter belonging to a harmonic signal composed of individual pulses of very short duration; such signals are also known as pulse-trains).

Several solutions exist to improve the subjective quality of transform-based audio codecs on harmonics audio signals. All of them exploit the long-term periodicity (pitch) of very harmonic, stationary waveforms, and are based on prediction-based techniques, either in the transform-domain or in the time-domain. Most of the solutions are known as either long-term prediction (LTP) or pitch prediction, characterized by a pair of filters being applied to the signal: a pre-filter in the encoder (usually as a first step in the time or frequency domain) and a post-filter in the decoder (usually as a last step in the time or frequency domain). A few other solutions, however, apply only a single post-filtering process on the decoder side generally known as harmonic post-filter or bass-post-filter. All of these approaches, regardless of being pre- and post-filter pairs or only post-filters, will be denoted as a harmonic filter tool in the following.

Examples of transform-domain approaches are:

[1] H. Fuchs, "Improving MPEG Audio Coding by Backward Adaptive Linear Stereo Prediction", 99th AES Convention, New York, 1995, Preprint 4086.

[2] L. Yin, M. Suonio, M. Vaananen, "A New Backward Predictor for MPEG Audio Coding", 103rd AES Convention, New York, 1997, Preprint 4521.

[3] Juha Ojanpera, Mauri Vaananen, Lin Yin, "Long Term Predictor for Transform Domain Perceptual Audio Coding", 107th AES Convention, New York, 1999, Preprint 5036.

Examples of time-domain approaches applying both pre- and post-filtering are:

[4] Philip J. Wilson, Harprit Chhatwal, "Adaptive transform coder having long term predictor", U.S. Pat. No. 5,012,517, Apr. 30, 1991.

[5] Jeongook Song, Chang-Heon Lee, Hyen-O Oh, Hong-Goo Kang, "Harmonic Enhancement in Low Bitrate Audio Coding Using an Efficient Long-Term Predictor", EURASIP Journal on Advances in Signal Processing, August 2010.

[6] Juin-Hwey Chen, "Pitch-based pre-filtering and post-filtering for compression of audio signals", U.S. Pat. No. 8,738,385, May 27, 2014.

[7] Jean-Marc Valin, Koen Vos, Timothy B. Terriberry, "Definition of the Opus Audio Codec", ISSN: 2070-1721, IETF RFC 6716, September 2012.

[8] Rakesh Taori, Robert J. Sluijter, Eric Kathmann "Transmission System with Speech Encoder with Improved Pitch Detection", U.S. Pat. No. 5,963,895, Oct. 5, 1999.

Examples of time-domain approaches where only post-filtering is applied are:

[9] Juin-Hwey Chen, Allen Gersho, "Adaptive Postfiltering for Quality Enhancement of Coded Speech", IEEE Trans. on Speech and Audio Proc., vol. 3, January 1995.

[10] Int. Telecommunication Union, "Frame error robust variable bit-rate coding of speech and audio from 8-32 kbit/s", Recommendation ITU-T G.718, June 2008. www.itu.int/rec/T-REC-G.718/e, section 7.4.1.

[11] Int. Telecommunication Union, "Coding of speech at 8 kbits using conjugate structure algebraic CELP (CS-ACELP)", Recommendation ITU-T G.729, June 2012. www.itu.int/rec/T-REC-G.729/e, section 4.2.1.

[12] Bruno Bessette et al., "Method and device for frequency-selective pitch enhancement of synthesized speech", U.S. Pat. No. 7,529,660, May 30, 2003.

An example of a transient detector is:

[13] Johannes Hilpert et al., "Method and Device for Detecting a Transient in a Discrete-Time Audio Signal", U.S. Pat. No. 6,826,525, Nov. 30, 2004.

Relevant literature on psychoacoustics:

[14] Hugo Fastl, Eberhard Zwicker, "Psychoacoustics: Facts and Models", 3rd Edition, Springer, Dec. 14, 2006.

[15] Christoph Markus, "Background Noise Estimation", European Patent EP 2,226,794, Mar. 6, 2009.

All the techniques described in the prior have decisions when to enable the prediction filter based on a single threshold decision (e.g. prediction gain [5] or pitch gain [4] or harmonicity which is basically proportional to the normalized correlation [6]). Furthermore, OPUS [7] employs hysteresis that increases the threshold if the pitch is changing and decreases the threshold if the gain in the previous frame was above a predefined fixed threshold. OPUS [7] also disables the long-term (pitch) predictor if a transient is detected in some specific frame configurations. The reason for this design seems to stem from the general belief that, in a mix of harmonic and transient signal components, the transient dominates the mix, and activating LTP or pitch prediction upon it would, as discussed earlier, subjectively cause more harm than improvement. However, for some mixtures of waveforms which will be discussed hereafter, activating the long-term or pitch predictor on transient audio frames significantly increases the coding quality or efficiency and thus is beneficial. Furthermore, it may be beneficial to, when activating the predictor, vary its strength based on instantaneous signal characteristics other than a prediction gain, the only approach in the state of the art.

Accordingly, it is an object of the present invention to provide a concept for a harmonicity-dependent controlling of a harmonic filter tool of an audio codec which results in an improved coding efficiency, e.g. improved objective coding gain or better perceptual quality or the like.

SUMMARY

According to an embodiment, an apparatus for performing a harmonicity-dependent controlling of a harmonic filter tool of an audio codec may have: a pitch estimator configured to determine a pitch of an audio signal to be processed by the audio codec; a harmonicity measurer configured to determine a measure of harmonicity of the audio signal using the pitch; a temporal structure analyzer configured to determine, depending on the pitch, at least one temporal structure measure measuring a characteristic of a temporal structure of the audio signal; a controller configured to control the harmonic filter tool depending on the temporal structure measure and the measure of harmonicity.

According to an embodiment, an audio encoder or audio decoder may have a harmonic filter tool and the apparatus for performing a harmonicity-dependent controlling of the harmonic filter tool as mentioned above.

According to an embodiment, a system may have: an apparatus for performing a harmonicity-dependent controlling of a harmonic filter tool as mentioned above, wherein the controller is configured to control the harmonic filter tool at units of frames, and the temporal structure analyzer is configured to sample an energy of the audio signal at a sample rate higher than a frame rate of the frames so as to acquire energy samples of the audio signal and to determine the at least one temporal structure measure on the basis of the energy samples; and a transient detector configured to detect transients in an audio signal to be processed by the audio codec on the basis of the energy samples.

Another embodiment may have a transform-based encoder having the system as mentioned above, configured to switch a transform block and/or overlap length depending on the detected transients.

Another embodiment may have an audio encoder having the system as mentioned above, configured to support switching between a transform coded excitation mode and a code excited linear prediction mode depending on the detected transients.

According to an embodiment, a method for performing a harmonicity-dependent controlling of a harmonic filter tool of an audio codec may have the steps of: determining a pitch of an audio signal to be processed by the audio codec; determining a measure of harmonicity of the audio signal using the pitch; determining, depending on the pitch, at least one temporal structure measure measuring a characteristic of a temporal structure of the audio signal; controlling the harmonic filter tool depending on the temporal structure measure and the measure of harmonicity.

Another embodiment may have a non-transitory digital storage medium having a computer program stored thereon to perform the method for performing a harmonicity-dependent controlling of a harmonic filter tool of an audio codec, which method may have the steps of: determining a pitch of an audio signal to be processed by the audio codec; determining a measure of harmonicity of the audio signal using the pitch; determining, depending on the pitch, at least one temporal structure measure measuring a characteristic of a temporal structure of the audio signal; controlling the harmonic filter tool depending on the temporal structure measure and the measure of harmonicity; when said computer program is run by a computer.

It is a basic finding of the present application that the coding efficiency of an audio codec using a controllable—switchable or even adjustable—harmonic filter tool may be improved by performing the harmonicity-dependent controlling of this tool using a temporal structure measure in addition to a measure of harmonicity in order to control the harmonic filter tool. In particular, the temporal structure of the audio signal is evaluated in a manner which depends on the pitch. This enables to achieve a situation-adapted control of the harmonic filter tool such that in situations where a control made solely based on the measure of harmonicity would decide against or reduce the usage of this tool although using the harmonic filter tool would, in that situation, increase the coding efficiency, the harmonic filter tool is applied, while in other situations where the harmonic filter tool may be inefficient or even destructive, the control reduces the appliance of the harmonic filter tool appropriately.

BRIEF DESCRIPTION OF THE DRAWINGS

Embodiments of the present application are set out below with respect to the figures among which

FIG. 2 shows an example for a possible predetermined condition to be met for applying the harmonic filter tool;

DETAILED DESCRIPTION OF THE INVENTION

Figure 1:
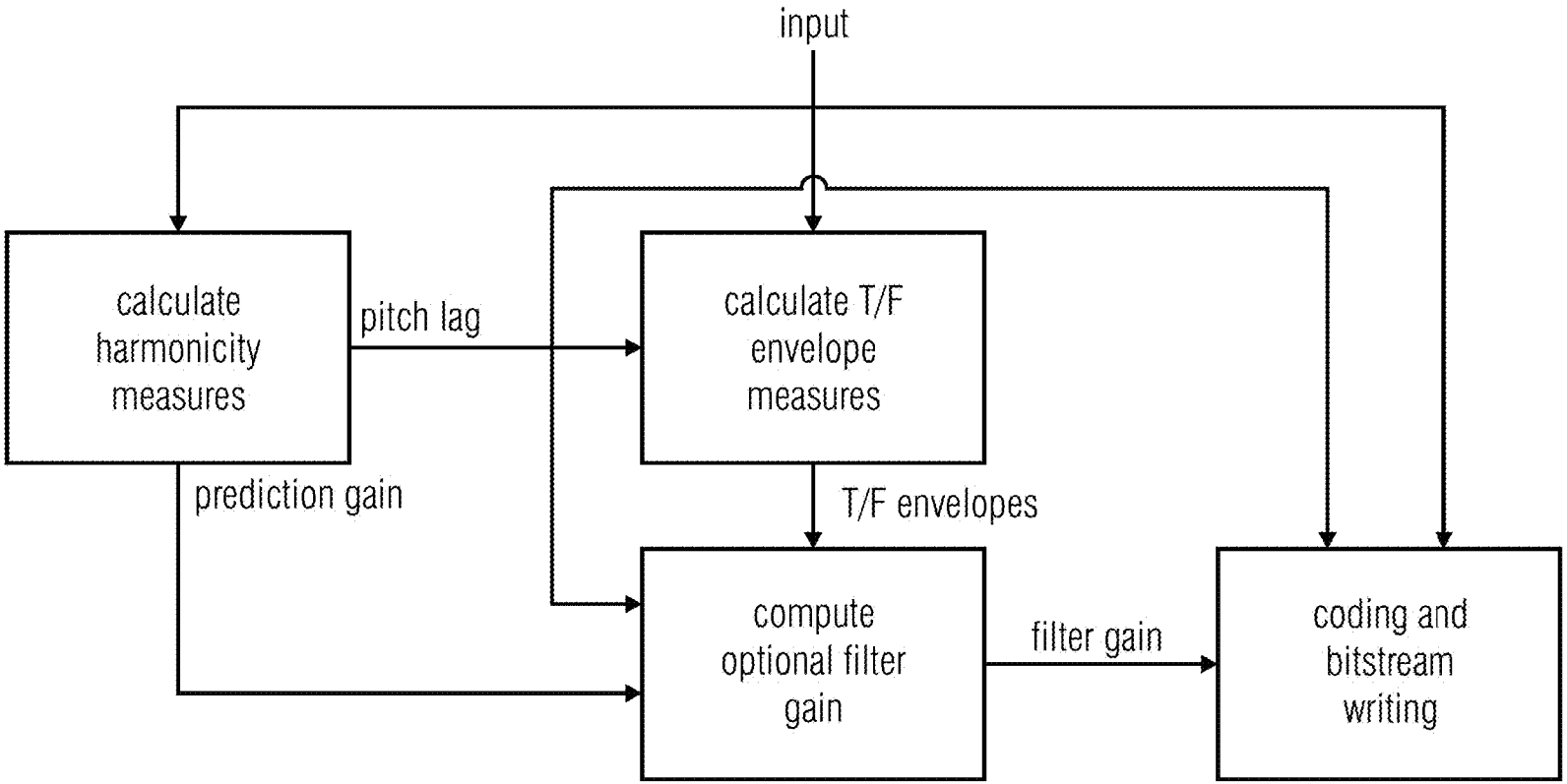
FIG. 1 shows a block diagram of an apparatus for controlling a harmonic filter tool in terms of filter gain in accordance with an embodiment.

The following description starts with a first detailed embodiment of a harmonic filter tool control. A brief survey of thoughts, which led to this first embodiment, are presented. These thoughts, however, also apply to the subsequently explained embodiments. Thereinafter, generalizing embodiments are presented, followed by specific concrete examples for audio signal portions in order to more concretely outline the effects resulting from embodiments of the present application.

The decision mechanism for enabling or controlling a harmonic filter tool of, for example, a prediction based technique, is, based on a combination of a harmonicity measure such as a normalized correlation or prediction gain and a temporal structure measure, e.g. temporal flatness measure or energy change.

The decision may, as outlined below, not be dependent just on the harmonicity measure from the current frame, but also on a harmonicity measure from the previous frame and on a temporal structure measure from the current and, optionally, from the previous frame.

The decision scheme may be designed such that the prediction based technique is enabled also for transients, whenever using it would be psychoacoustically beneficial as concluded by a respective model.

Thresholds used for enabling the prediction based technique may be, in one embodiment, dependent on the current pitch instead on the pitch change.

The decision scheme allows, for example, to avoid repetition of a specific transient, but allow prediction based technique for some transients and for signals with specific temporal structures where a transient detector would normally signal short transform blocks (i.e. the existence of one or more transients).

The decision technique presented below may be applied to any of the prediction-based methods described above, either in the transform-domain or in the time-domain, either pre-filter plus post-filter or post-filter only approaches. Moreover, it can be applied to predictors operating band-limited (with lowpass) or in subbands (with bandpass characteristics).

The overall objective regarding the activating of LTP, pitch prediction, or harmonic post-filtering is that both of the following conditions are achieved:

- An objective or subjective benefit is obtained by activating the filter,
- No significant artifacts are introduced by the activation of said filter.

Determining whether there is an objective benefit to using the filter usually performed by means of autocorrelation and/or prediction gain measures on the target signal and is well known [1-7].

The measurement of a subjective benefit is also straightforward at least for stationary signals, since perceptual improvement data obtained through listening tests are typically proportional to the corresponding objective measures, i.e. the abovementioned correlation and/or prediction gain.

Identifying or predicting the existence of artifacts caused by the filtering, though, may use more sophisticated techniques than simple comparisons of objective measures like frame type (long transforms for stationary vs. short transforms for transient frames) or prediction gain to certain thresholds, as is done in the state of the art. Essentially, in order to prevent artifacts one has to ensure that the changes the filtering causes in the target waveform do not significantly exceed a time-varying spectro-temporal masking threshold anywhere in time or frequency. The decision scheme in accordance with some of the embodiments presented below, thus, uses the following filter decision and control scheme consisting of three algorithmic blocks to be executed in series for each frame of the audio signal to be coded and/or subjected to the filtering:

- A harmonicity measurement block which calculates commonly used harmonic filter data such as normalized correlation or gain values (referred to as "prediction gain" hereafter). As noted again later, the word "gain" is meant as a generalization for any parameter commonly associated with a filter's strength, e.g. an explicit gain factor or the absolute or relative magnitude of a set of one or more filter coefficients.
- A T/F envelope measurement block which computes time-frequency (T/F) amplitude or energy or flatness data with a predefined spectral and temporal resolution (this may also include measures of frame transientness used for frame type decisions, as noted above). The pitch obtained in the harmonicity measurement block is input to the T/F envelope measurement block since the region of the audio signal used for filtering of the current frame, typically using past signal samples, depends on the pitch (and, correspondingly, so does the computed T/F envelope).

A filter gain computation block performing the final decision about which filter gain to use (and thus to transmit in the bit-stream) for the filtering. Ideally, this block should compute, for each transmittable filter gain less than or equal to the prediction gain, a spectro-temporal excitation-pattern-like envelope of the target signal after filtering with said filter gain, and should compare this "actual" envelope with an excitation-pattern envelope of the original signal. Then, one may use for coding/transmission the largest filter gain whose corresponding spectro-temporal "actual" envelope does not differ from the "original" envelope by more than a certain amount. This filter gain we shall call psychoacoustically optimal.

In other embodiments described later, the three-block structure is a little bit modified.

In other words, harmonicity and T/F envelope measures are obtained in corresponding blocks, which are subsequently used to derive psychoacoustic excitation patterns of both the input and filtered output frames, and finally the filter gain is adapted such that a masking threshold, given by a ratio between the "actual" and the "original" envelope, is not significantly exceeded. To appreciate this, it should be noted that an excitation pattern in this context is very similar to a spectrogram-like representation of the signal being examined, but exhibits temporal smoothing modeled after certain characteristics of human hearing and manifesting itself as "post-masking". FIG. 1 illustrates the connection between the three blocks introduced above. Unfortunately, a frame-wise derivation of two excitation patterns and a brute-force search for the best filter gain often is computationally complex. Therefore simplifications are presented in the following description.

In order to avoid expensive computations of excitation patterns in the proposed filter-activation decision scheme, low-complexity envelope measures are used as estimates of the characteristics of the excitation patterns. It was found that in the T/F envelope measurement block, data such as segmental energies (SE), temporal flatness measure (TFM), maximum energy change (MEC) or traditional frame configuration info such as the frame type (long/stationary or short/transient) suffice to derive estimates of psychoacoustic criteria. These estimates then can be utilized in the filter gain computation block to determine, with high accuracy, an optimal filter gain to be employed for coding or transmission. In order to prevent a computationally intensive search for the globally optimal gain, a rate-distortion loop over all possible filter gains (or a sub-set thereof) can be substituted by one-time conditional operators. Such "cheap" operators serve to decide whether some filter gain, computed using data from the harmonicity and T/F envelope measurement blocks, shall be set to zero (decision not to use harmonic filtering) or not (decision to use harmonic filtering). Note that the harmonicity measurement block can remain unchanged. A step-by-step realization of this low-complexity embodiment is described hereafter.

As noted, the "initial" filter gain subjected to the one-time conditional operators is derived using data from the harmonicity and T/F envelope measurement blocks. More specifically, the "initial" filter gain may be equal to the product of the time-varying prediction gain (from the harmonicity measurement block) and a time-varying scale factor (from the psychoacoustic envelope data of the T/F envelope measurement block). In order to further reduce the computational load a fixed, constant scale factor such as 0.625 may be used instead of the signal-adaptive time-variant one. This typically retains sufficient quality and is also taken into account in the following realization.

A step-by-step description of a concrete embodiment for controlling of the filter tool is laid out now.

1. Transient Detection and Temporal Measures

The input signal $s_{HP}(n)$ is input to the time-domain transient detector. The input signal $s_{HP}(n)$ is high-pass filtered. The transfer function of the transient detection's HP filter is given by $$H_{TD}(z)=0.375-0.5z^{-1}+0.125z^{-2} \tag{1}$$

The signal, filtered by the transient detection's HP filter, is denoted as $s_{TD}(n)$. The HP-filtered signal $s_{TD}(n)$ is segmented into 8 consecutive segments of the same length. The energy of the HP-filtered signal $s_{TD}(n)$ for each segment is calculated as:

$$E_{TD}(i) = \sum_{n=0}^{L_{segment}-1} (s_{TD}(iL_{segment}+n))^2,\ i=0,\ldots,7 \tag{2}$$

$$\text{where } L_{segment} = \frac{L}{8}$$

is the number of samples in 2.5 milliseconds segment at the input sampling frequency.

An accumulated energy is calculated using:

$$E_{Acc}=\max(E_{TD}(i-1),0.8125E_{Acc}) \tag{3}$$

An attack is detected if the energy of a segment $E_{TD}(i)$ exceeds the accumulated energy by a constant factor$_{attackRati\ o=8.5}$ and the attackIndex is set to i:

$$E_{TD}(i)>\text{attackRatio}\cdot E_{Acc} \tag{4}$$

If no attack is detected based on the criteria above, but a strong energy increase is detected in segment i, the attackIndex is set to i without indicating the presence of an attack. The attackIndex is basically set to the position of the last attack in a frame with some additional restrictions.

The energy change for each segment is calculated as:

$$E_{chng}(i) = \begin{cases} \dfrac{E_{TD}(i)}{E_{TD}(i-1)}, & E_{TD}(i) > E_{TD}(i-1) \\ \dfrac{E_{TD}(i-1)}{E_{TD}(i)}, & E_{TD}(i-1) > E_{TD}(i) \end{cases} \tag{5}$$

The temporal flatness measure is calculated as:

$$TFM(N_{past}) = \frac{1}{8+N_{past}} \sum_{i=-N_{past}}^{7} E_{chng}(i) \tag{6}$$

The maximum energy change is calculated as:

$$MEC(N_{past},N_{new})=\max(E_{chng}(-N_{past}),E_{chng}(-N_{past}+1),\ldots,E_{chng}(N_{new}-1)) \tag{7}$$

If index of $E_{chng}(i)$ or $E_{TD}(i)$ is negative then it indicates a value from the previous segment, with segment indexing relative to the current frame.

$N_{past}$ is the number of the segments from the past frames. It is equal to 0 if the temporal flatness measure is calculated for the usage in ACELP/TCX decision. If the temporal flatness measure is calculate for the TCX LTP decision then it is equal to:

$$N_{past} = 1 + \min\left(8, \left\lceil 8\frac{\text{pitch}}{L} + 0.5\right\rceil\right) \tag{8}$$

$N_{new}$ is the number of segments from the current frame. It is equal to 8 for non-transient frames. For transient frames first the locations of the segments with the maximum and the minimum energy are found:

$$i_{max} = \underset{i\in\{-N_{past},\ldots,7\}}{\operatorname{argmax}} E_{TD}(i) \tag{9}$$

$$i_{min} = \underset{i\in\{-N_{past},\ldots,7\}}{\operatorname{argmin}} E_{TD}(i) \tag{10}$$

If $E_{TD}(i_{min})>0.375E_{TD}(i_{max})$ then $N_{new}$ is set to $i_{max}-3$, otherwise $N_{new}$ is set to 8.

2. Transform Block Length Switching

The overlap length and the transform block length of the TCX are dependent on the existence of a transient and its location.

TABLE 1

Coding of the overlap and the transform length based on the transient position

| attack Index | Overlap with the first window of the following frame | Short/Long Transform decision (binary coded) 0 - Long, 1 - Short | Binary code for the overlap width | Overlap code |
|---|---|---|---|---|
| none | ALDO | 0 | 0 | 00 |
| −2 | FULL | 1 | 0 | 10 |
| −1 | FULL | 1 | 0 | 10 |
| 0 | FULL | 1 | 0 | 10 |
| 1 | FULL | 1 | 0 | 10 |
| 2 | MINIMAL | 1 | 10 | 110 |
| 3 | HALF | 1 | 11 | 111 |
| 4 | HALF | 1 | 11 | 111 |
| 5 | MINIMAL | 1 | 10 | 110 |
| 6 | MINIMAL | 0 | 10 | 010 |
| 7 | HALF | 0 | 11 | 011 |

The transient detector described above basically returns the index of the last attack with the restriction that if there are multiple transients then MINIMAL overlap is more advantageous than HALF overlap which is more advantageous than FULL overlap. If an attack at position 2 or 6 is not strong enough then HALF overlap is chosen instead of the MINIMAL overlap.

3. Pitch Estimation

One pitch lag (integer part+fractional part) per frame is estimated (frame size e.g. 20 ms). This is done in 3 steps to reduce complexity and improves estimation accuracy.

a. First Estimation of the Integer Part of the Pitch Lag

A pitch analysis algorithm that produces a smooth pitch evolution contour is used (e.g. Open-loop pitch analysis described in Rec. ITU-T G.718, sec. 6.6). This analysis is generally done on a subframe basis (subframe size e.g. 10 ms), and produces one pitch lag estimate per subframe. Note that these pitch lag estimates do not have any fractional part and are generally estimated on a downsampled signal (sampling rate e.g. 6400 Hz). The signal used can be any audio signal, e.g. a LPC weighted audio signal as described in Rec. ITU-T G.718, sec. 6.5.

b. Refinement of the Integer Part of the Pitch Lag

The final integer part of the pitch lag is estimated on an audio signal x[n] running at the core encoder sampling rate, which is generally higher than the sampling rate of the downsampled signal used in a. (e.g. 12.8 kHz, 16 kHz, 32 kHz . . . ). The signal x[n] can be any audio signal e.g. a LPC weighted audio signal.

The integer part of the pitch lag is then the lag $T_{int}$ that maximizes the autocorrelation function $$C(d) = \sum_{n=0}^{L} x[n]x[n-d]$$

with d around a pitch lag T estimated in step 1.a.

$$T-\delta_1 \le d \le T+\delta_2$$

c. Estimation of the Fractional Part of the Pitch Lag

The fractional part is found by interpolating the autocorrelation function C(d) computed in step 2.b. and selecting the fractional pitch lag $T_{fr}$ which maximizes the interpolated autocorrelation function. The interpolation can be performed using a low-pass FIR filter as described in e.g. Rec. ITU-T G.718, sec. 6.6.7.

4. Decision Bit

If the input audio signal does not contain any harmonic content or if a prediction based technique would introduce distortions in time structure (e.g. repetition of a short transient), then no parameters are encoded in the bitstream. Only 1 bit is sent such that the decoder knows whether he has to decode the filter parameters or not. The decision is made based on several parameters:

Normalized correlation at the integer pitch-lag estimated in step 3.b.

$$\text{norm_corr} = \frac{\sum_{n=0}^{L} x[n]x[n-T_{int}]}{\sqrt{\sum_{n=0}^{L} x[n]x[n]}\sqrt{\sum_{n=0}^{L} x[n-T_{int}]x[n-T_{int}]}}$$

The normalized correlation is 1 if the input signal is perfectly predictable by the integer pitch-lag, and 0 if it is not predictable at all. A high value (close to 1) would then indicate a harmonic signal. For a more robust decision, beside the normalized correlation for the current frame (norm_corr(curr)) the normalized correlation of the past frame (norm_corr(prev)) can also be used in the decision., e.g.:

If (norm_corr(curr)*norm_corr(prev))>0.25 or

If max(norm_corr(curr),norm_corr(prev))>0.5, then the current frame contains some harmonic content (bit=1)

a. Features computed by a transient detector (e.g. Temporal flatness measure (6), Maximal energy change (7)), to avoid activating the postfilter on a signal containing a strong transient or big temporal changes. The temporal features are calculated on the signal containing the current frame ($N_{new}$ segments) and the past frame up to the pitch lag ($N_{past}$ segments). For step like transients that are slowly decaying, all or some of the features are calculated only up to the location of the transient ($i_{max}-3$) because the distortions in the nonharmonic part of the spectrum introduced by the LTP filtering would be suppressed by the masking of the strong long lasting transient (e.g. crash cymbal).

b. Pulse trains for low pitched signals can be detected as a transient by a transient detector. For the signals with low pitch the features from the transient detector are thus ignored and there is instead additional threshold for the normalized correlation that depends on the pitch lag, e.g.:

If norm_corr<=1.2−$T_{int}$/L, then set the bit=0 and do not send any parameters.

One example decision is shown in FIG. 2 where b1 is some bitrate, for example 48 kbps, where TCX_20 indicates that the frame is coded using single long block, where TCX_10 indicates that the frame is coded using 2,3,4 or more short blocks, where TCX_20/TCX_10 decision is based on the output of the transient detector described above. tempFlatness is the Temporal Flatness Measure as defined in (6), maxEnergyChange is the Maximum Energy Change as defined in (7). The condition norm_corr(curr)>1.2−$T_{int}$/L could also be written as (1.2-norm_corr(curr))*L<$T_{int}$.

Figure 3:
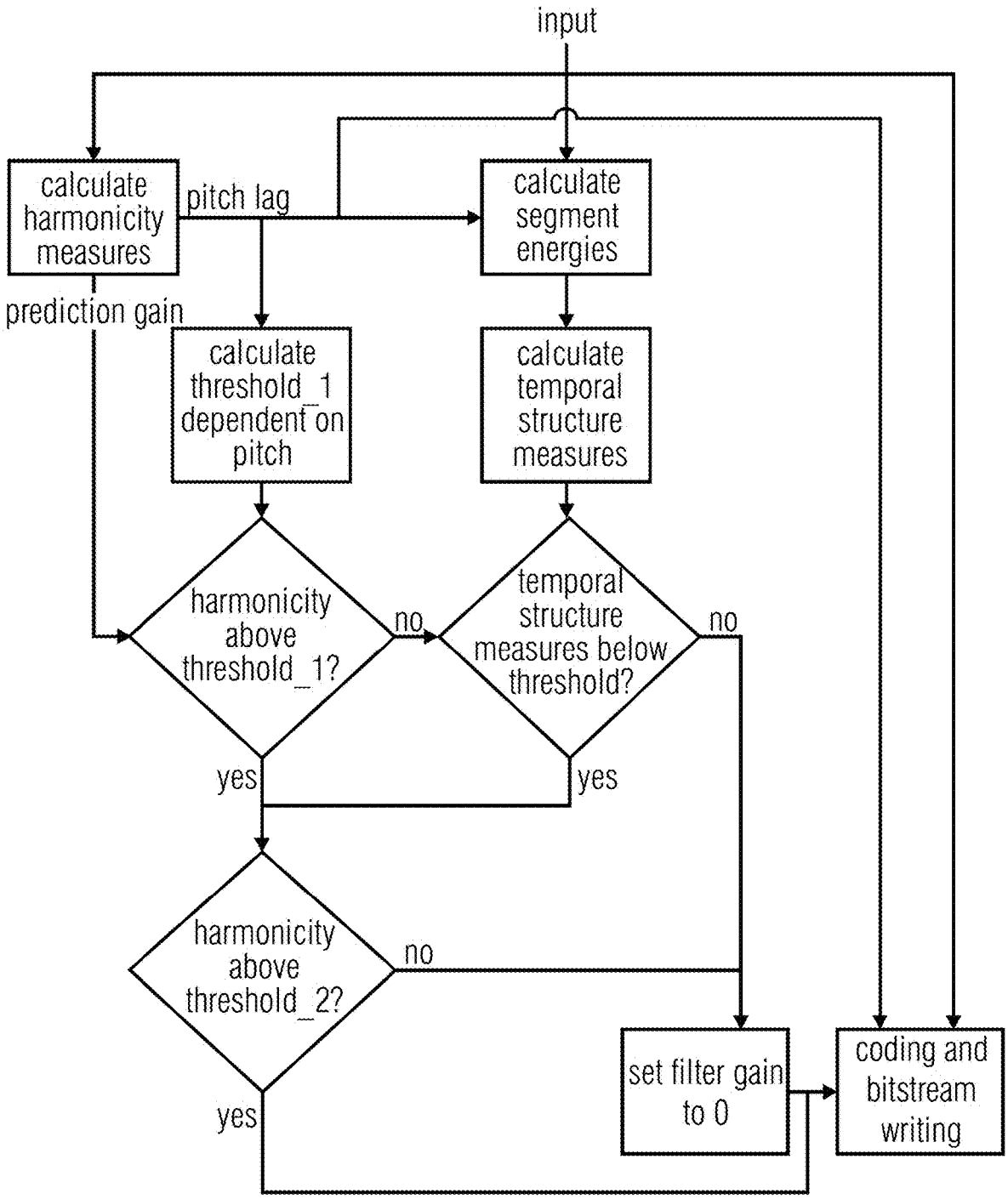
FIG. 3 shows a flow diagram illustrating a possible implementation of a decision logic which, inter alias, could be parameterized so as to realize the condition example of FIG. 2.

The principle of the decision logic is depicted in the block diagram in FIG. 3. It should be noted that FIG. 3 is more general than FIG. 2 in sense that the thresholds are not restricted. They may be set according to FIG. 2 or differently. Moreover, FIG. 3 illustrates that the exemplary bitrate dependency of FIG. 2 may be left-off. Naturally, the decision logic of FIG. 3 could be varied to include the bitrate dependency of FIG. 2. Further, FIG. 3 has been held unspecific with regard to the usage of only the current or also the past pitch. Insofar, FIG. 3 shows that the embodiment of FIG. 2 may be varied in this regard.

The "threshold" in FIG. 3 corresponds to different thresholds used for tempFlatness and maxEnergyChange in FIG. 2. The "threshold_1" in FIG. 3 corresponds to 1.2-$T_{int}$/L in FIG. 2. The "threshold_2" in FIG. 3 corresponds to 0.44 or max(norm_corr(curr),norm_corr(prev))>0.5 or (norm_corr(curr)*norm_corr_prev)>0.25 in FIG. 2

It is obvious from the examples above that the detection of a transient affects which decision mechanism for the long term prediction will be used and what part of the signal will be used for the measurements used in the decision, and not that it directly triggers disabling of the long term prediction.

The temporal measures used for the transform length decision may be completely different from the temporal measures used for the LTP decision or they may overlap or be exactly the same but calculated in different regions.

For low pitched signals the detection of transients is completely ignored if the threshold for the normalized correlation that depends on the pitch lag is reached.

5. Gain Estimation and Quantization

The gain is generally estimated on the input audio signal at the core encoder sampling rate, but it can also be any audio signal like the LPC weighted audio signal. This signal is noted y[n] and can be the same or different than x[n].

The prediction $y_P[n]$ of y[n] is first found by filtering y[n] with the following filter $$P(z)=B(z,T_{fr})z^{-T_{int}}$$

with $T_{int}$ the integer part of the pitch lag (estimated in0) and $B(z,T_{fr})$ a low-pass FIR filter whose coefficients depend on the fractional part of the pitch lag $T_{fr}$ (estimated in0).

One example of B(z) when the pitch lag resolution is ¼:

$$T_{fr}=0/4B(z)=0.0000z^{-2}+0.2325z^{-1}+0.5349z^{0}+0.2325z^{1}$$

$$T_{fr}=1/4B(z)=0.0152z^{-2}+0.3400z^{-1}+0.5094z^{0}+0.1353z^{1}$$

$$T_{fr}=2/4B(z)=0.0609z^{-2}+0.4391z^{-1}+0.4391z^{0}+0.0609z^{1}$$

$$T_{fr}=3/4B(z)=0.1353z^{-2}+0.5094z^{-1}+0.3400z^{0}+0.0152z^{1}$$

The gain g is then computed as follows:

$$g=\frac{\sum_{n=0}^{L-1} y[n]y_P[n]}{\sum_{n=0}^{L-1} y_P[n]y_P[n]}$$

and limited between 0 and 1.

Finally, the gain is quantized e.g. on 2 bits, using e.g. uniform quantization.

If the gain is quantized to 0, then no parameters are encoded in the bitstream, only the 1 decision bit (bit=0).

The description brought forward so far motivated and outlined the advantages of embodiments of the present application for a harmonicity-dependent control of a harmonic filter tool, also for the ones outlined below which represent generalized embodiments to the step-by-step embodiment above. Sometimes the description brought forward so far was very specific although the harmonicity-dependent control concept may also advantageously be used in the framework of other audio codecs and may be varied relative to the specific details outlined in the foregoing. For this reason, embodiments of the present application are described again in the following in a more generic manner. Nevertheless, from time to time the following description refers back to the detailed description brought forward above in order to use the above details in order to reveal as to how the generically described elements occurring below may be implemented in accordance with further embodiments. In doing so, it should be noted that all of these specific implementation details may be individually transferred from the above description towards the elements described below. Accordingly, whenever in the description outlined below reference is made to the description brought forward above, this reference is meant to be independent from further references to the above description.

Figure 4:
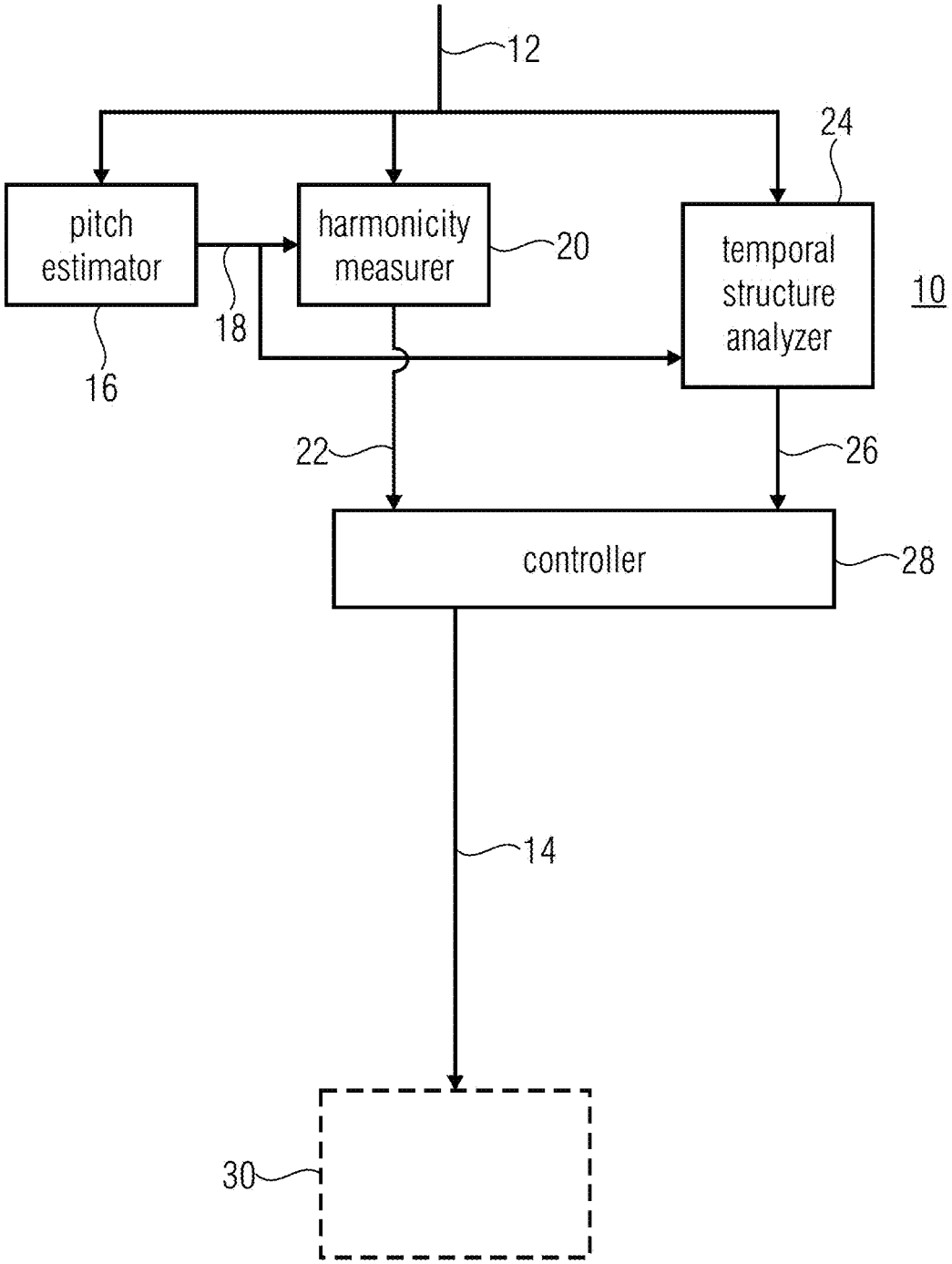
FIG. 4 shows a block diagram of an apparatus for performing a harmonicity (and temporal-measure) dependent controlling of a harmonic filter tool.

Thus, a more generic embodiment which emerges from the above detailed description is depicted in FIG. 4. In particular, FIG. 4 shows an apparatus for performing a harmonicity-dependent controlling of a harmonic filter tool, such as a harmonic pre/post filter or harmonic post-filter tool, of an audio codec. The apparatus is generally indicated using reference sign 10. Apparatus 10 receives the audio signal 12 to be processed by the audio codec and outputs a control signal 14 to fulfill the controlling task of apparatus 10. Apparatus 10 comprises a pitch estimator 16 configured to determine a current pitch lag 18 of the audio signal 12, and a harmonicity measurer 20 configured to determine a measure 22 of harmonicity of the audio signal 12 using a current pitch lag 18. In particular, the harmonicity measure may be a prediction gain or may be embodied by one (single-) or more (multi-tap) filter coefficients or a maximum normalized correlation. The harmonicity measure calculation block of FIG. 1 comprised the tasks of both pitch estimator 16 and harmonicity measurer 20.

The apparatus 10 further comprises a temporal structure analyzer 24 configured to determine at least one temporal structure measure 26 in a manner dependent on the pitch lag 18, measure 26 measuring a characteristic of a temporal structure of the audio signal 12. For example, the dependency may rely in the positioning of the temporal region within which measure 26 measures the characteristic of a temporal structure of the audio signal 12, as described above and later in more detail. For sake of completeness, however, it is briefly noted that the dependency of the determination of measure 26 on the pitch-lag 18 may also be embodied differently to the description above and below. For example, instead of positioning the temporal portion, i.e. the determination window, in a manner dependent on the pitch-lag, the dependency could merely temporally vary weights at which a respective time-interval of the audio signal within a window positioned independently from the pitch-lag relative to the current frame, contribute to the measure 26. Relating to the description below, this may mean that the determination window 36 could be steadily located to correspond to the concatenation of the current and previous frames, and that the pitch-dependently located portion merely functions as a window of increased weight at which the temporal structure of the audio signal influences the measure 26. However, for the time being, it is assumed that the temporal window is located positioned according to the pitch-lag. Temporal structure analyzer 24 corresponds to the T/F envelope measure calculation block of FIG. 1.

Finally, the apparatus of FIG. 4 comprises a controller 28 configured to output control signal 14 depending on the temporal structure measure 26 and the measure 22 of harmonicity so as to thereby control the harmonic pre/post filter or harmonic post-filter. When comparing FIG. 4 with FIG. 1, the optimal filter gain computation block corresponds to, or represents a possible implementation of, controller 28.

The mode of operation of apparatus 10 is as follows. In particular, the task of apparatus 10 is to control the harmonic filter tool of an audio codec, and although the above-outlined more detailed description with respect to FIGS. 1 to 3 reveals a gradual control or adaptation of this tool in terms of its filter strength or filter gain, for example, controller 28 is not restricted to that type of gradual control. Generally speaking, the control by controller 28 may gradually adapt the filter strength or gain of the harmonicity filter tool between 0 and a maximum value, both inclusively, as it was the case in the above specific examples with respect to FIGS. 1 to 3, but different possibilities are feasible as well, such as a gradual control between two non-zero filter gain values, a step-wise control or a binary control such as a switching between enablement (non-zero) or disablement (zero gain) to switch on or off the harmonic filter tool.

As became clear from the above discussion, the harmonic filter tool which is illustrated in FIG. 4 by dashed lines 30 aims at improving the subjective quality of an audio codec such as a transform-based audio codec, especially with respect to harmonic phases of the audio signal. In particular, such a tool 30 is especially useful in low bitrate scenarios where a quantization noise introduced would, without tool 30, lead in such harmonic phases to audible artifacts. It is important, however, that filter tool 30 does not negatively affect other temporal phases of the audio signal which are not predominately harmonic. Further, as outlined above, filter tool 30 may be of the post-filter approach or pre-filter plus post-filter approach. Pre and/or post-filters may operate in transform domain or time domain. For example, a post-filter of tool 30 may, for example, have a transfer function having local maxima arranged at spectral distances corresponding to, or being set dependent on, pitch lag 18. The implementation of pre-filter and/or post-filter in the form of an LTP filter, in the form of, for example, an FIR and IIR filter, respectively, is also feasible. The pre-filter may have a transfer function being substantially the inverse of the transfer function of the post-filter. In effect, the pre-filter seeks to hide the quantization noise within the harmonic component of the audio signal by increasing the quantization noise within the harmonic of the current pitch of the audio signal and the post-filter reshapes the transmitted spectrum accordingly. In case of the post-filter only approach, the post-filter really modifies the transmitted audio signal so as to filter quantization noise occurring the between the harmonics of the audio signal's pitch.

It should be noted that FIG. 4 is, in some sense, drawn in a simplifying manner. For example, although FIG. 4 suggests that pitch estimator 16, harmonicity measurer 20 and temporal structure analyzer 24 operate, i.e. perform their tasks, on the audio signal 12 directly, or at least at the same version thereof, this does not need to be the case. Actually, pitch-estimator 16, temporal structure analyzer 24 and harmonicity measurer 20 may operate on different versions of the audio signal 12 such as different ones of the original audio signal and some pre-modified version thereof, wherein these versions may vary among elements 16, 20 and 24 internally and also with respect to the audio codec as well, which may also operate on some modified version of the original audio signal. For example, the temporal structure analyzer 24 may operate on the audio signal 12 at the input sampling rate thereof, i.e. the original sampling rate of audio signal 12, or it may operate on an internally coded/decoded version thereof. The audio codec, in turn, may operate at some internal core sampling rate which is usually lower than the input sampling rate. The pitch-estimator 16, in turn, may perform its pitch estimation task on a pre-modified version of the audio signal, such as, for example, on a psychoacoustically weighted version of the audio signal 12 so as to improve the pitch estimation with respect to spectral components which are, in terms of perceptibility, more significant than other spectral components. For example, as described above, the pitch-estimator 16 may be configured to determine the pitch lag 18 in stages comprising a first stage and a second stage, the first stage resulting in a preliminary estimation of the pitch lag which is then refined in the second stage. For example, as it has been described above, pitch estimator 16 may determine a preliminary estimation of the pitch lag at a down-sampled domain corresponding to a first sample rate, and then refining the preliminary estimation of the pitch lag at a second sample rate which is higher than the first sample rate.

As far as the harmonicity measurer 20 is concerned, it has become clear from the discussion above with respect to FIGS. 1 to 3 that it may determine the measure 22 of harmonicity by computing a normalized correlation of the audio signal or a pre-modified version thereof at the pitch lag 18. It should be noted that harmonicity measurer 20 may even be configured to compute the normalized correlation even at several correlation time distances besides the pitch lag 18 such as in a temporal delay interval including and surrounding the pitch lag 18. This may be favorable, for example, in case of filter tool 30 using a multi-tap LTP or possible LTP with fractional pitch. In that case, harmonicity measurer 20 may analyze or evaluate the correlation even at lag indices neighboring the actual pitch lag 18, such as the integer pitch lag in the concrete example outlined above with respect to FIGS. 1 to 3.

For further details and possible implementations of the pitch estimator 16, reference is made to the section "pitch estimation" brought forward above. Possible implementations of the harmonicity measurer 20 were discussed above with respect to the equation of norm.corr. However, as also described above, the term "harmonicity measure" shall include not only a normalized correlation but also hints at measuring the harmonicity such as a prediction gain of the harmonic filter, wherein that harmonic filter may be equal to or may be different to the pre-filter of filter 230 in case of using the pre/post-filter approach and irrespective of the audio codec using this harmonic filter or as to whether this harmonic filter is merely used by harmonic measurer 20 so as to determine measure 22.

Figure 5:
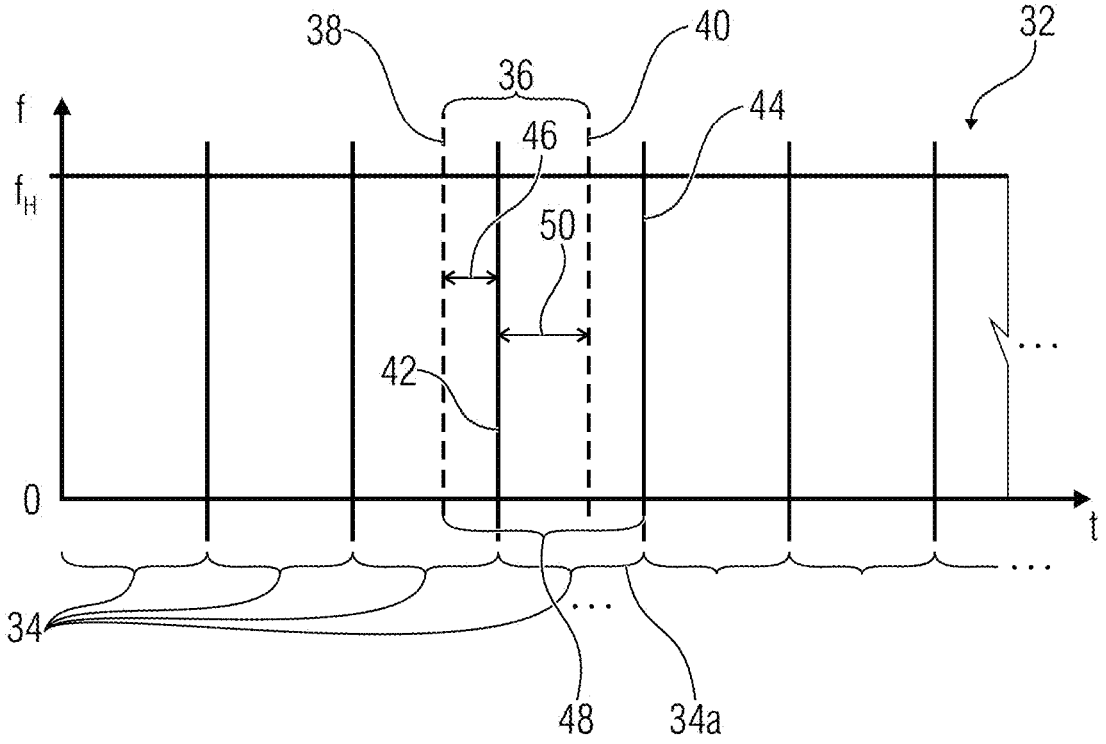
FIG. 5 shows a schematic diagram illustrating the temporal position of a temporal region for determining the temporal structure measure in accordance with an embodiment.

As was described above with respect to FIGS. 1 to 3, the temporal structure analyzer 24 may be configured to determine the at least one temporal structure measure 26 within a temporal region temporally placed depending on the pitch lag 18. In order to illustrate this further, see FIG. 5. FIG. 5 illustrates a spectrogram 32 of the audio signal, i.e. its spectral decomposition up to some highest frequency $f_H$ depending on, for example, the sample rate of the version of the audio signal internally used by the temporal structure analyzer 24, temporally sampled at some transform block rate which may or may not coincide with an audio codec's transform block rate, if any. For illustration purposes, FIG. 5 illustrates the spectrogram 32 as being temporally subdivided into frames in units of which the controller may, for example, perform its controlling of filter tool 30, which frame subdivisioning may, for example, also coincide with the frame subdivision used by the audio codec comprising or using filter tool 30.

For the time being, it is illustratively assumed that the current frame for which the controlling task of controller 28 is performed, is frame 34*a*. As was described above and as is illustrated in FIG. 5, the temporal region 36, within which temporal structure analyzer determiner determines the at least one temporal structure measure 26, does not necessarily coincide with current frames 34*a*. Rather, both the temporally past-heading end 38 as well as the temporally future-heading end 40 of the temporal region 36 may deviate from the temporally past-heading and future heading ends 42 and 44 of the current frame 34*a*. As has been described above, the temporal structure analyzer 24 may position the temporally past-heading end 38 of the temporal region 36 depending on the pitch lag 18 determined by pitch estimator 16 which determines the pitch lag 18 for each frame 34, for current frame 34*a*. As became clear from the discussion above, the temporal structure analyzer 24 may position the temporal past-heading end 38 of the temporal region such that the temporally past-heading end 38 is displaced into a past direction relative to the current frame's 34*a* past-heading end 42, for example, by a temporal amount 46 which monotonically increases with an increase of the pitch lag 18. In other words, the greater the pitch lag 18 is, the greater amount 46 is. As became clear from the discussion above with respect to FIGS. 1 to 3, the amount may be set according to equation 8, where $N_{past}$ is a measure for the temporal displacement 46.

The temporally future-heading end 40 of temporal region 36, in turn, may be set by temporal structure analyzer 24 depending on the temporal structure of the audio signal within a temporal candidate region 48 extending from the temporally past-heading end 38 of the temporal region 36 to the temporally future-heading end of the current frame, 44. In particular, as has been discussed above, the temporal structure analyzer 24 may evaluate a disparity measure of energy samples of the audio signal within the temporal candidate region 48 so as to decide on the position of the temporally future-heading end 40 of temporal region 36. In the above specific details presented with respect to FIGS. 1 to 3, a measure for a difference between maximum and minimum energy samples within the temporal candidate region 48 were used as the disparity measure, such an amplitude ratio therebetween. In particular, in the above concrete example, variable $N_{new}$ measured the position of the temporally future-heading end 40 of temporal future 36 with respect to the temporally past-heading end 42 of the current frame 34*a* a indicated at 50 in FIG. 5.

As became clear from the above discussion, the placement of the temporal region 36 dependent on pitch lag 18 is advantageous in that the apparatus's 10 ability to correctly identify situations where the harmonic filter tool 30 may advantageously be used is increased. In particular, the correct detection of such situations is made more reliable, i.e. such situations are detected at higher probability without substantially increasing falsely positive detection.

Figure 6:
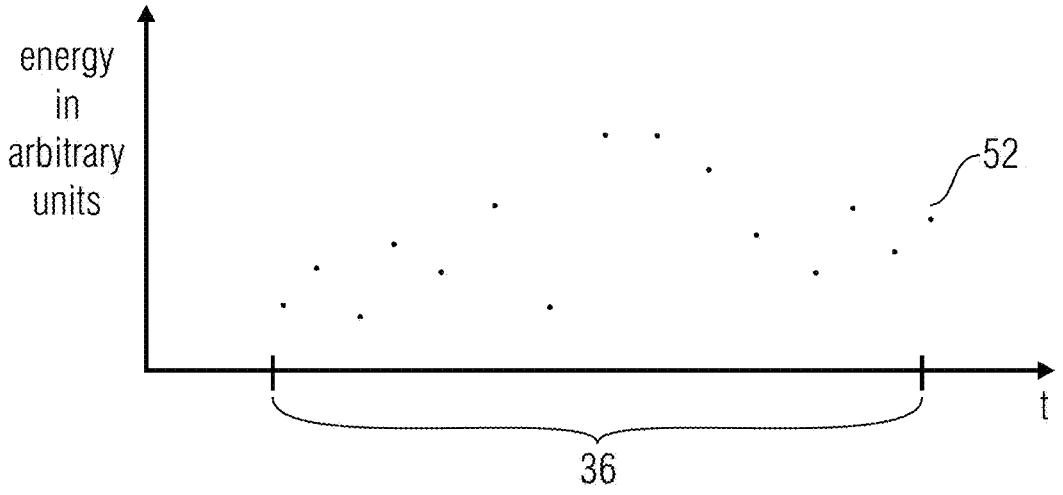
FIG. 6 shows schematically a graph of energy samples temporally sampling the energy of the audio signal within the temporal region in accordance with an embodiment.

As was described above with respect to FIGS. 1 to 3, the temporal structure analyzer 24 may determine the at least one temporal structure measure within the temporal region 36 on the basis of a temporal sampling of the audio signal's energy within that temporal region 36. This is illustrated in FIG. 6, where the energy samples are indicated by dots plotted in a time/energy plane spanned by arbitrary time and energy axes. As explained above, the energy samples 52 may have been obtained by sampling the energy of the audio signal at a sample rate higher than the frame rate of frames 34. In determining the at least one temporal structure measure 26, analyzer 24 may, as described above, compute for example a set of energy change values during a change between pairs of immediately consecutive energy samples 52 within temporal region 36. In the above description, equation 5 was used to this end. By way of this measure, an energy change value may be obtained from each pair of immediately consecutive energy samples 52. Analyzer 24 may then subject the set of energy change values obtained from the energy samples 52 within temporal region 36 to a scalar function to obtain the at least one structural energy measure 26. In the above concrete example, the temporal flatness measure, for example, has been determined on the basis of a sum over addends, each of which depends on exactly one of the set of energy change values. The maximum energy change, in turn, was determined according to equation 7 using a maximum operator applied onto the energy change values.

As already noted above, the energy samples 52 do not necessarily measure the energy of the audio signal 12 in its original, unmodified version. Rather, the energy sample 52 may measure the energy of the audio signal in some modified domain. In the concrete example above, for example, the energy samples measured the energy of the audio signal as obtained after high pass filtering the same. Accordingly, the audio signal's energy at a spectrally lower region influences the energy samples 52 less than spectrally higher components of the audio signal. Other possibilities exist, however, as well. In particular, it should be noted that the example where the temporal structure analyzer 24 merely uses one value of the at least one temporal structure measure 26 per sample time instant in accordance with the examples presented so far, is merely one embodiment and alternatives exist according to which the temporal structure analyzer determine the temporal structure measure in a spectrally discriminating manner so as to obtain one value of the at least one temporal structure measure per spectral band of a plurality of spectral bands. Accordingly, the temporal structure analyzer 24 would then provide to the controller 28 more than one value of the at least one temporal structure measure 26 for the current frame 34*a* as determined within the temporal region 36, namely one per such spectral band, wherein the spectral bands partition, for example, the overall spectral interval of spectrogram 32.

Figure 7:
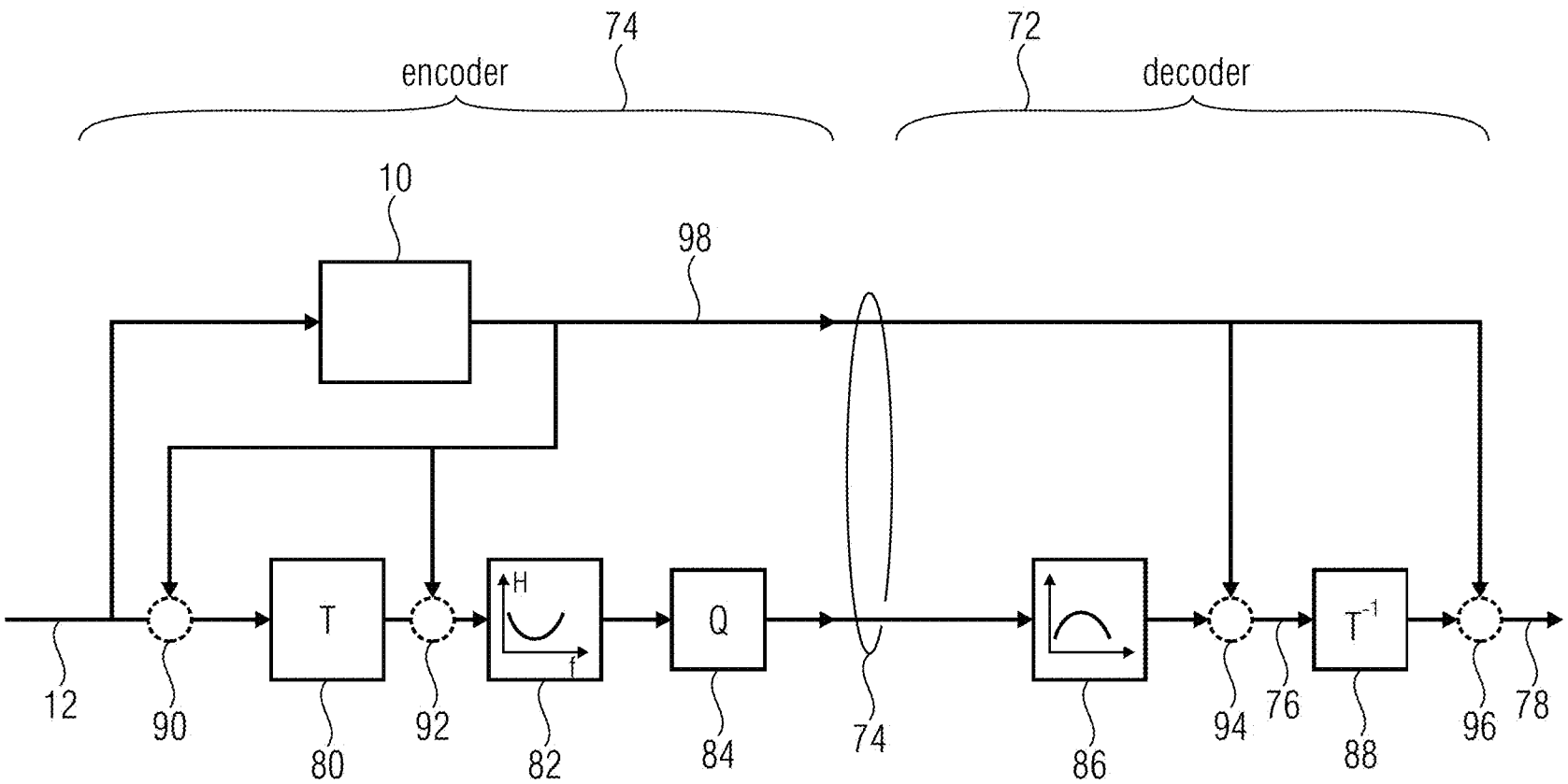
FIG. 7 shows a block diagram illustrating the usage of the apparatus of FIG. 4 in an audio codec by illustrating the encoder and the decoder of the audio codec, respectively, when the encoder uses the apparatus of FIG. 4, in accordance with an embodiment wherein a harmonic pre-/post-filter tool is used.

FIG. 7 illustrates the apparatus 10 and its usage in an audio codec supporting the harmonic filter tool 30 according to the harmonic pre/post filter approach. FIG. 7 shows a transform-based encoder 70 as well as a transform-based decoder 72 with the encoder 70 encoding audio signal 12 into a data stream 74 and decoder 72 receiving the data stream 74 so as to reconstruct the audio signal either in spectral domain as illustrated at 76 or, optionally, in time-domain illustrated at 78. It should be clear that encoder and decoder 70 and 72 are discrete/separate entities and shown in FIG. 7 concurrently merely for illustration purposes.

The transform-based encoder 70 comprises a transformer 80 which subjects the audio signal 12 to a transform. Transformer 80 may use a lapped transform such a critically sampled lapped transform, an example of which is MDCT. In the example of FIG. 7, the transform-based audio encoder 70 also comprises a spectral shaper 82 which spectrally shapes the audio signal's spectrum as output by transformer 80. Spectral shaper 82 may spectrally shape the spectrum of the audio signal in accordance with a transfer function being substantially an inverse of a spectral perceptual function. The spectral perceptual function may be derived by way of linear prediction and thus, the information concerning the spectral perceptual function may be conveyed to the decoder 72 within data stream 74 in the form of, for example, linear prediction coefficients in the form of, for example, quantized line spectral pair of line spectral frequency values. Alternatively, a perceptual model may be used to determine the spectral perceptual function in the form of scale factors, one scale factor per scale factor band, which scale factor bands may, for example, coincide with bark bands. The encoder 70 also comprises a quantizer 84 which quantizes the spectrally shaped spectrum with, for example, a quantization function which is equal for all spectral lines. The thus spectrally shaped and quantized spectrum is conveyed within data stream 74 to decoder 72.

For the sake of completeness only, it should be noted that the order among transformer 80 and spectral shaper 82 has been chosen in FIG. 7 for illustration purposes only. Theoretically, spectral shaper 82 could cause the spectral shaping in fact within the time-domain, i.e. upstream transformer 80. Further, in order to determine the spectral perceptual function, spectral shaper 82 could have access to the audio signal 12 in time-domain although not specifically indicated in FIG. 7. At the decoder side, decoder 72 is illustrated in FIG. 7 as comprising a spectral shaper 86 configured to shape the inbound spectrally shaped and quantized spectrum as obtained from data stream 74 with the inverse of the transfer function of spectral shaper 82, i.e. substantially with the spectral perceptual function, followed by an optional inverse transformer 88. The inverse transformer 88 performs the inverse transformation relative to transformer 80 and may, for example, to this end perform a transform block-based inverse transformation followed by an overlap-add-process in order to perform time-domain aliasing cancellation, thereby reconstructing the audio signal in time-domain.

As illustrated in FIG. 7, a harmonic pre-filter may be comprised by encoder 70 at a position upstream or downstream transformer 80. For example, a harmonic pre-filter 90 upstream transformer 80 may subject the audio signal 12 within the time-domain to a filtering so as to effectively attenuate the audio signal's spectrum at the harmonics in addition to the transfer function or spectral shaper 82. Alternatively, the harmonic pre-filter may be positioned downstream transformer 80 with such pre-filter 92 performing or causing the same attenuation in the spectral domain. As shown in FIG. 7, corresponding post-filters 94 and 96 are positioned within the decoder 72: in case of pre-filter 92, within spectral domain post-filter 94 positioned upstream inverse transformer 88 inversely shapes the audio signal's spectrum, inverse to the transfer function of pre-filter 92, and in case of pre-filter 90 being used, post filter 96 performs a filtering of the reconstructed audio signal in the time-domain, downstream inverse transformer 88, with a transfer function inverse to the transfer function of pre-filter 90.

In the case of FIG. 7, apparatus 10 controls the audio codec's harmonic filter tool implemented by pair 90 and 96 or 92 and 94 by explicitly signaling control signals 98 via the audio codec's data stream 74 to the decoding side for controlling the respective post-filter and, in line with the control of the post-filter at the decoding side, controlling the pre-filter at the encoder side.

Figure 8:
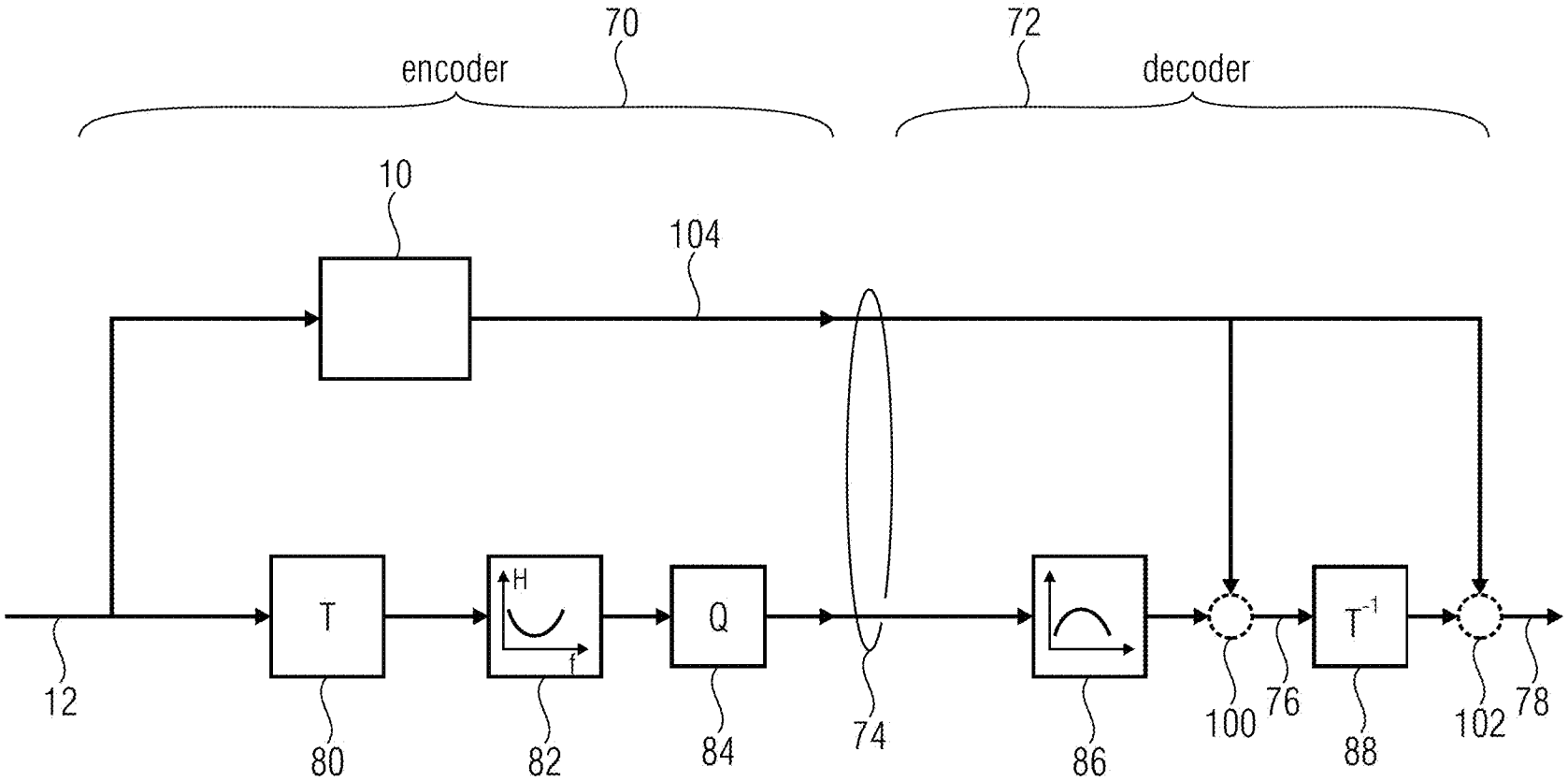
FIG. 8 shows a block diagram illustrating the usage of the apparatus of FIG. 4 in an audio codec by illustrating the encoder and the decoder of the audio codec, respectively, when the encoder uses the apparatus of FIG. 4, in accordance with an embodiment wherein a harmonic post-filter tool is used.

For the sake of completeness, FIG. 8 illustrates the usage of apparatus 10 using a transform-based audio codec also involving elements 80, 82, 84, 86 and 88, however, here illustrating the case where the audio codec supports the harmonic post-filter-only approach. Here, the harmonic filter tool 30 may be embodied by a post-filter 100 positioned upstream the inverse transformer 88 within decoder 72, so as to perform harmonic post filtering in the spectral domain, or by use of a post-filter 102 positioned downstream inverse transformer 88 so as to perform the harmonic post-filtering within decoder 72 within the time-domain. The mode of operation of post-filters 100 and 102 is substantially the same as the one of post-filters 94 and 96: the aim of these post-filters is to attenuate the quantization noise between the harmonics. Apparatus 10 controls these post-filters via explicit signaling within data stream 74, the explicit signaling indicated in FIG. 8 using reference sign 104.

As already described above, the control signal 98 or 104 is sent, for example, on a regular basis, such as per frame 34. As to the frames, it is noted that same are not necessarily of equal length. The length of the frames 34 may also vary.

Figure 9:
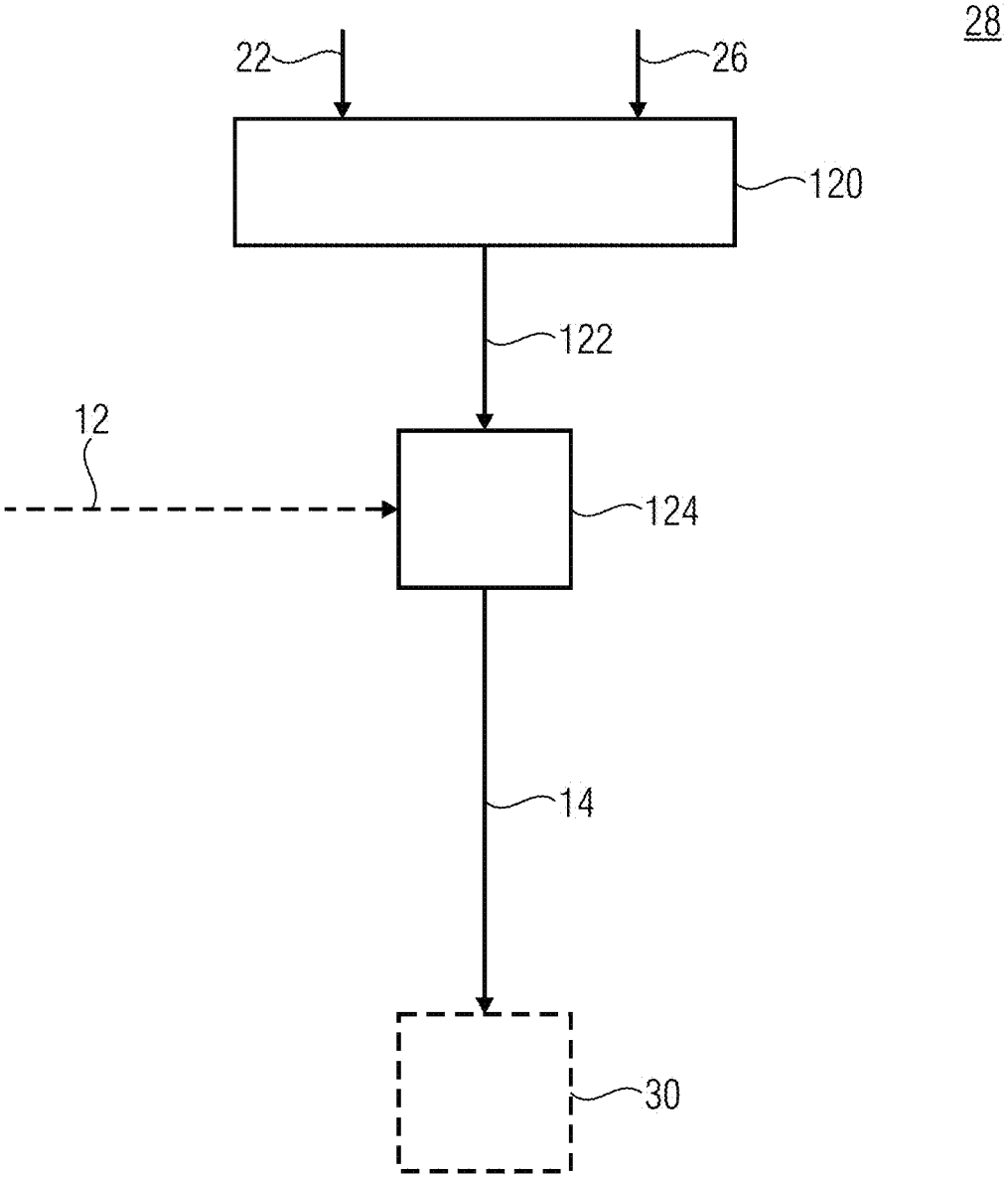
FIG. 9 shows a block diagram of the controller of FIG. 4 in accordance with an embodiment.

The above description, especially the one with regard to FIGS. 2 and 3, revealed possibilities as to how controller 28 controls the harmonic filter tool. As became clear from that discussion, it may be that the at least one temporal structure measure measures an average or maximum energy variation of the audio signal within the temporal region 36. Further, the controller 28 may include, within its control options, the disablement of the harmonic filter tool 30. This is illustrated in FIG. 9. FIG. 9 shows the controller 28 as comprising a logic 120 configured to check whether a predetermined condition is met by the at least one temporal structure measure and the harmonicity measure, so as to obtain a check result 122, which is of binary nature and indicates whether or not the predetermined condition is fulfilled. Controller 28 is shown as comprising a switch 124 configured to switch between enabling and disabling the harmonic filter tool depending on the check result 122. If the check result 122 indicates that the predetermined condition has been approved to be met by logic 120, switch 124 either directly indicates the situation by way of control signal 14, or switch 124 indicates the situation along with a degree of filter gain for the harmonic filter tool 30. That is, in the latter case, switch 124 would not switch between switching off the harmonic filter tool 30 completely and switching on the harmonic filter tool 30 completely, only, but would set the harmonic filter tool 30 to some intermediate state varying in the filter strength or filter gain, respectively. In that case, i.e. if switch 124 also adapts/controls the harmonic filter tool 30 somewhere between completely switching off and completely switching on tool 30, switch 124 may rely on the at last temporal structure measure 26 and the harmonicity measure 22 so as to determine the intermediate states of control signal 14, i.e. so as to adapt tool 30. In other words, switch 124 could determine the gain factor or adaptation factor for controlling the harmonic filter tool 30 also on the basis of measures 26 and 22. Alternatively, switch 124 uses for all states of control signal 14 not indicating the off state of harmonic filter tool 30, the audio signal 12 directly. If the check result 122 indicates that a predetermined condition is not met, then the control signal 14 indicates the disablement of the harmonic filter tool 30.

As became clear from the above description of FIGS. 2 and 3, the predetermined condition may be met if both the at least one temporal structure measure is smaller than a predetermined first threshold and the measure of harmonicity is, for a current frame and/or a previous frame, above a second threshold. An alternative may also exist: the predetermined condition may additionally be met if the measure of harmonicity is, for a current frame, above a third threshold and the measure of harmonicity is, for a current frame and/or a previous frame, above a fourth threshold which decreases with an increase of the pitch lag.

In particular, in the example of FIGS. 2 and 3, there were actually three alternatives for which the predetermined condition is met, the alternatives being dependent on the at least one temporal structure measure:

1. One temporal structure measure<threshold and combined harmonicity for current and previous frame>second threshold;
2. One temporal structure measure<third threshold and (harmonicity for current or previous frame)>fourth threshold;
3. (One temporal structure measure<fifth threshold or all temp. measures<thresholds) and harmonicity for current frame>sixth threshold.

Thus, FIG. 2 and FIG. 3, reveal possible implementation examples for logic 124.

Figure 10:
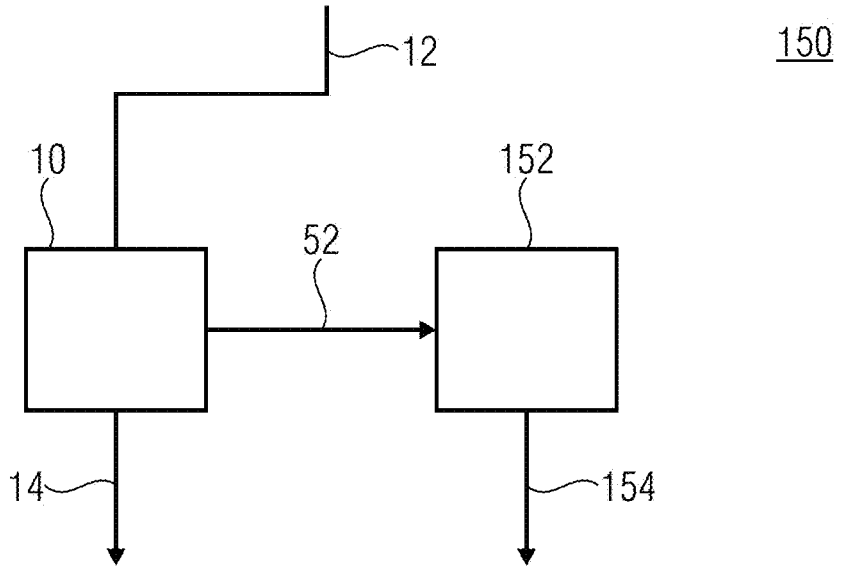
FIG. 10 shows a block diagram of a system illustrating the possibility that the apparatus of FIG. 4 shares the use of the energy samples of FIG. 6 with a transient detector.

As has been illustrated above with respect to FIGS. 1 to 3, it is feasible that apparatus 10 is not only used for controlling a harmonic filter tool of an audio codec. Rather, the apparatus 10 may form, along with a transient detection, a system able to perform both control of the harmonic filter tool as well as detecting transients. FIG. 10 illustrates this possibility. FIG. 10 shows a system 150 composed of apparatus 10 and a transient detector 152, and while apparatus 10 outputs control signal 14 as discussed above, transient detector 152 is configured to detect transients in the audio signal 12. To do this, however, the transient detector 152 exploits an intermediate result occurring within apparatus 10: the transient detector 152 uses for its detection the energy samples 52 temporally or, alternatively, spectro-temporally sampling the energy of the audio signal, with, however, optionally evaluating the energy samples within a temporal region other than temporal region 36 such as within current frame 34*a*, for example. On the basis of these energy samples, transient detector 152 performs the transient detection and signals the transients detected by way of a detection signal 154. In case of the above example, the transient detection signal substantially indicated positions where the condition of equation 4 is fulfilled, i.e. where an energy change of temporally consecutive energy samples exceeds some threshold.

As also became clear from the above discussion, a transform-based encoder such as the one depicted in FIG. 8 or a transform-coded excitation encoder, may comprise or use the system of FIG. 10 so as to switch a transform block and/or overlap length depending on the transient detection signal 154. Further, additionally or alternatively, an audio encoder comprising or using the system of FIG. 10 may be of a switching mode type. For example, USAC and EVS use switching between modes. Thus, such an encoder could be configured to support switching between a transform coded excitation mode and a code excited linear prediction mode and the encoder could be configured to perform the switching dependent on the transient detection signal 154 of the system of FIG. 10. As far as the transform coded excitation mode is concerned, the switching of the transform block and/or overlap length could, again, be dependent on the transient detection signal 154.

EXAMPLES FOR THE ADVANTAGES OF THE ABOVE EMBODIMENTS

Example 1

The size of the region in which temporal measures for the LTP decision are calculated is dependent on the pitch (see equation (8)) and this region is different from the region where temporal measures for the transform length are calculated (usually current frame plus look-ahead).

Figure 11:
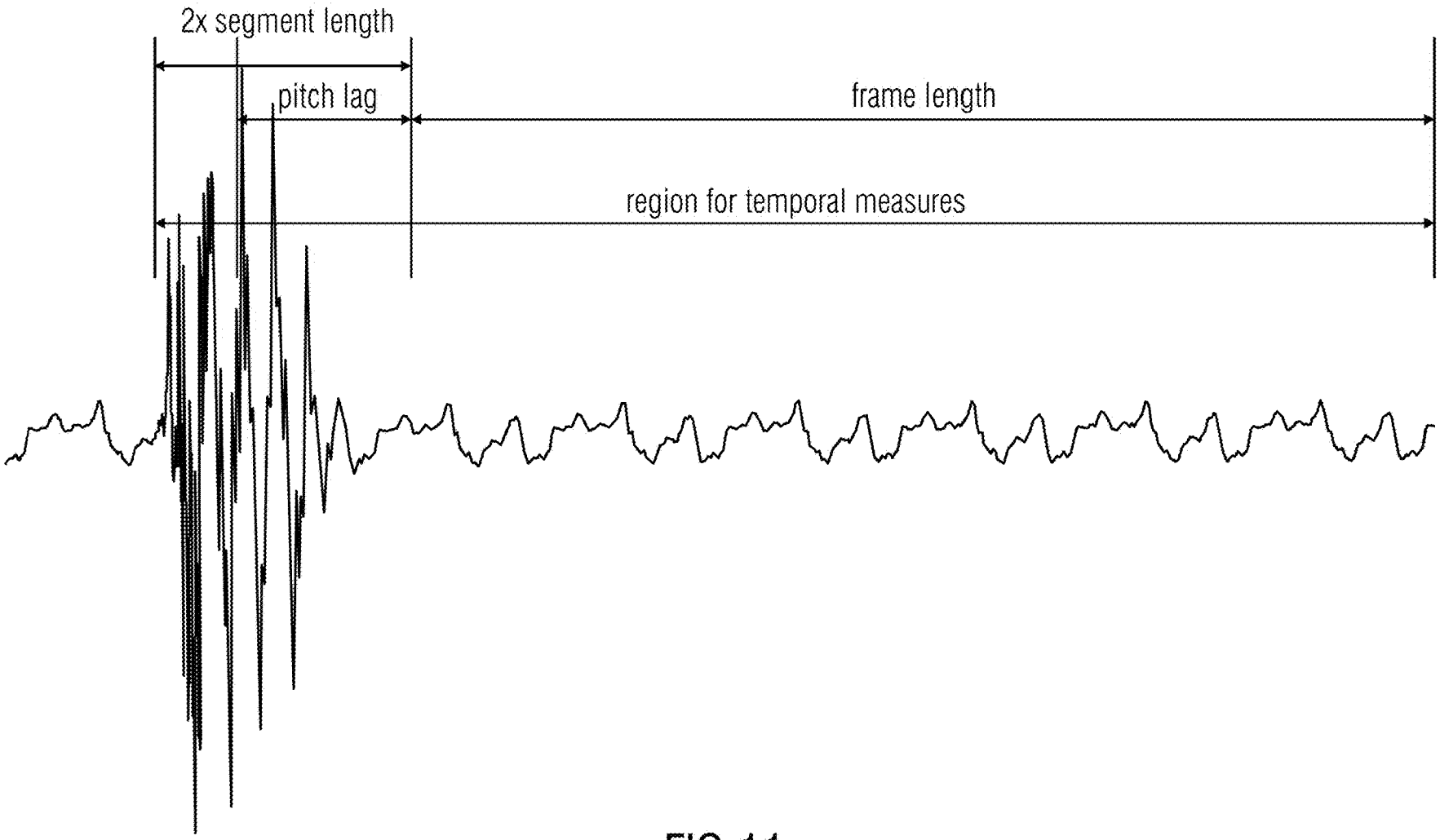
FIG. 11 shows a graph of a time-domain portion (portion of the waveform) out of an audio signal as an example of a low pitched signal with additionally illustrating the pitch dependent positioning of the temporal region for determining the at least one temporal structure measure.

In the example in FIG. 11 the transient is inside the region where the temporal measures are calculated and thus influences the LTP decision. The motivation, as stated above, is that a LTP for the current frame, utilizing past samples from the segment denoted by "pitch lag", would reach into a portion of the transient.

Figure 12:
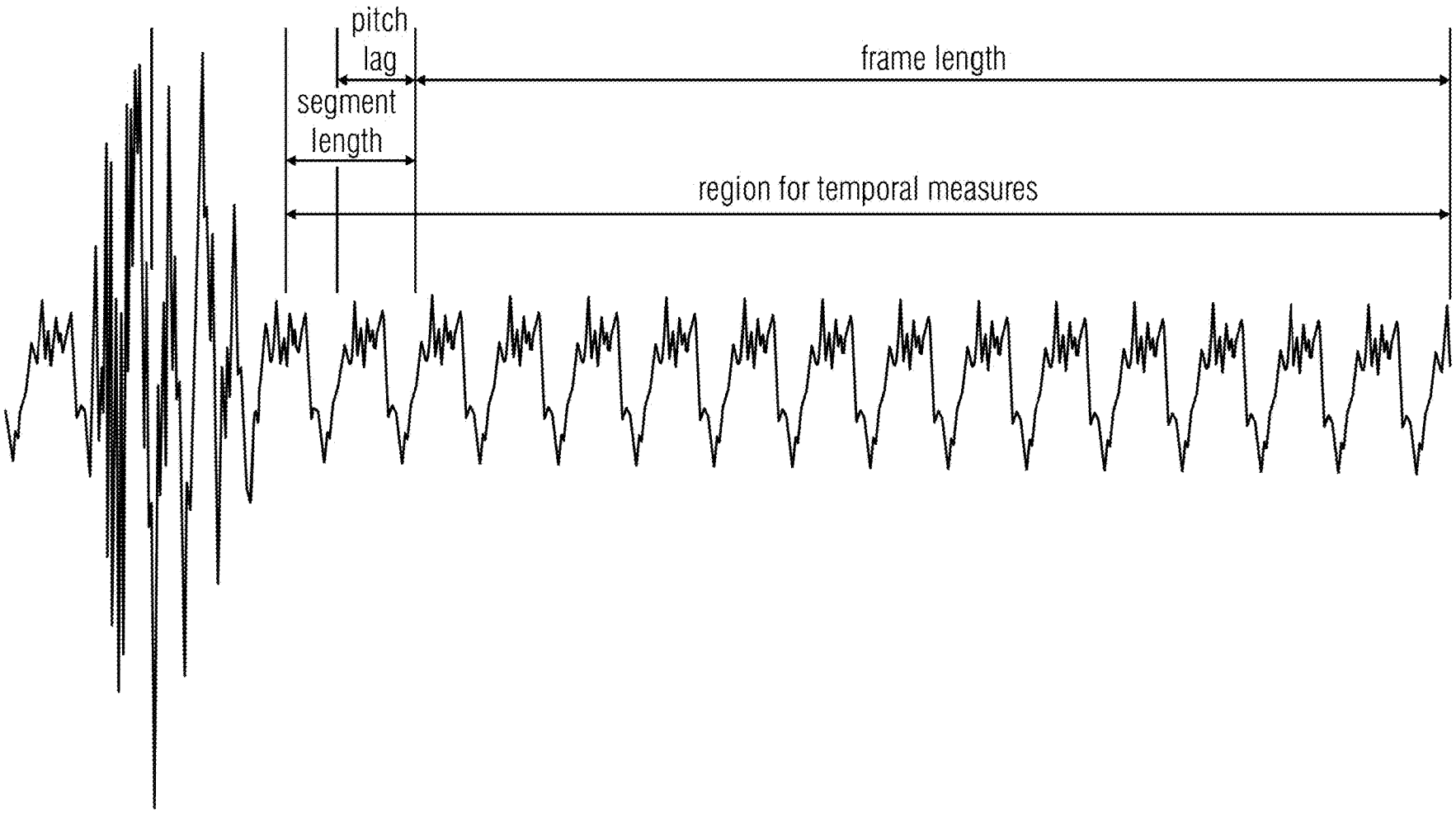
FIG. 12 shows a graph of a time-domain portion out of an audio signal as an example of a high pitched signal with additionally illustrating the pitch dependent positioning of the temporal region for determining the at least one temporal structure measure.

In the example in FIG. 12 the transient is outside the region where the temporal measures are calculated and thus doesn't influence the LTP decision. This is reasonable since, unlike in the previous figure, a LTP for the current frame would not reach into the transient.

In both examples (FIG. 11 and FIG. 12) the transform length configuration is decided on temporal measures only within the current frame, i.e. the region marked with "frame length". This means that in both examples, no transient would be detected in the current frame and a single long transform (instead of many successive short transforms) would be employed.

Example 2

Figure 13:
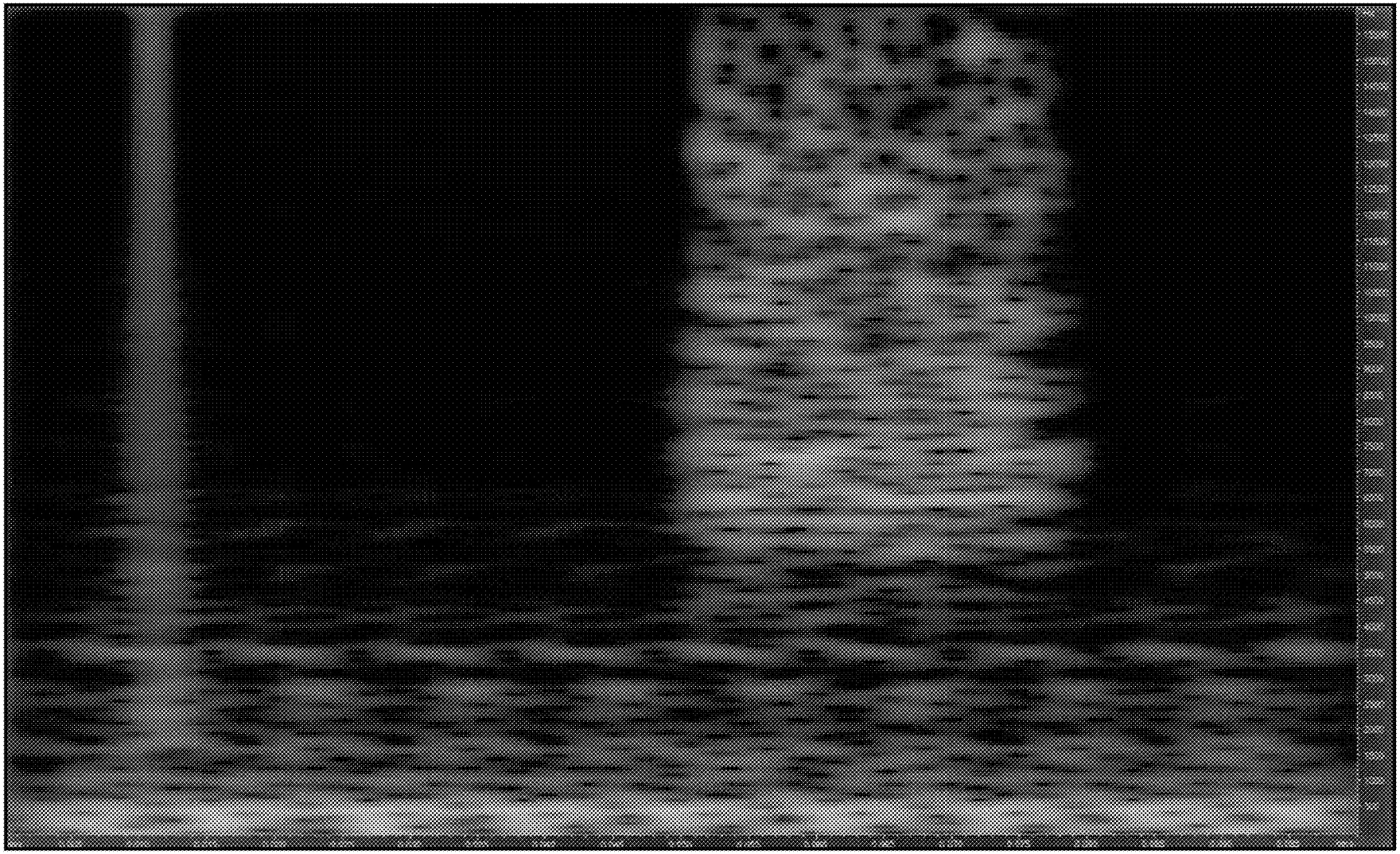
FIG. 13 shows an exemplary spectrogram of an impulse and step transient within a harmonic signal.

Here we discuss the behavior of the LTP for impulse and step transients within harmonic signal, of which one example is given by signal's spectrogram in FIG. 13.

Figure 14:
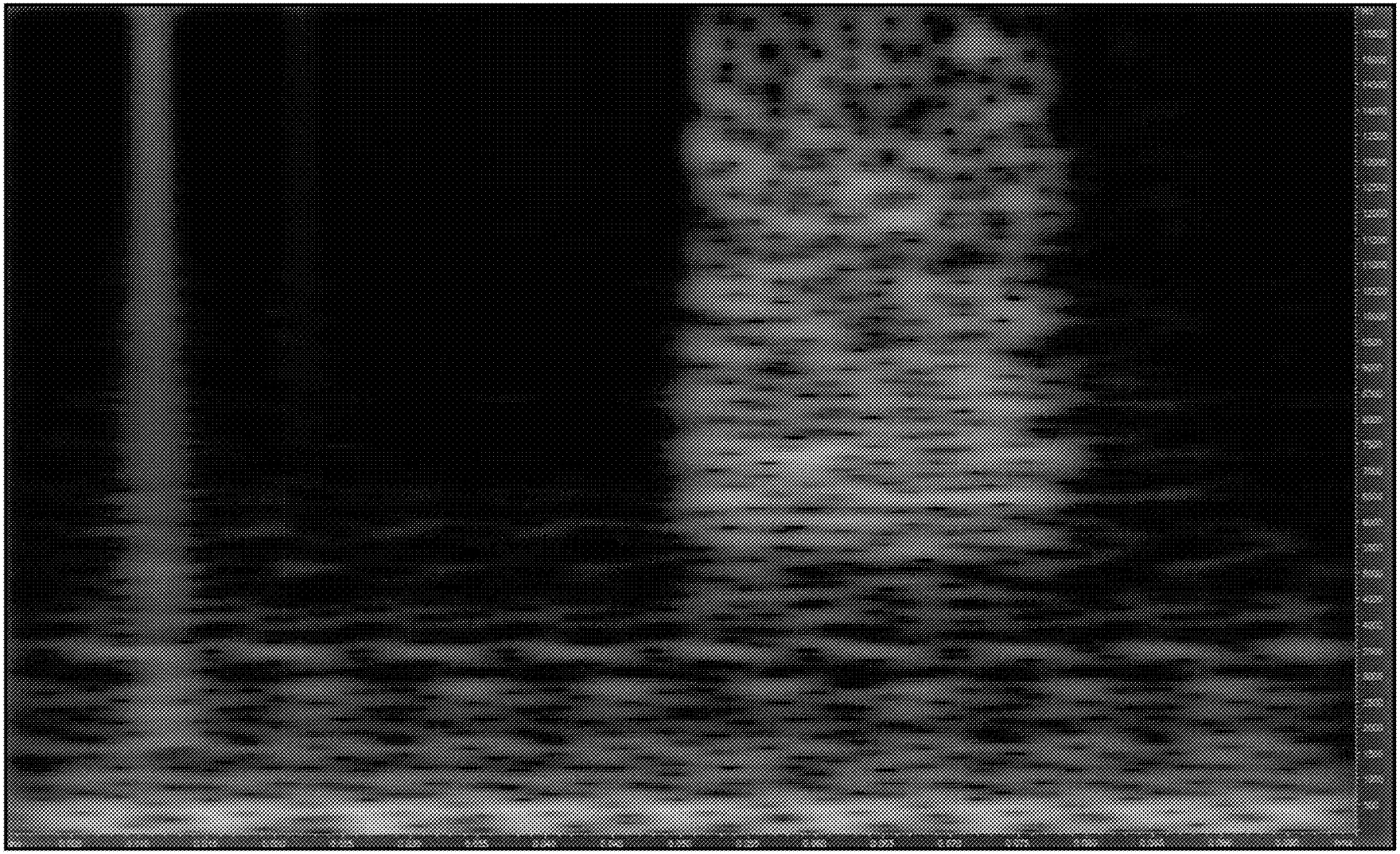
FIG. 14 shows an exemplary spectrogram to illustrate an LTP influence on impulse and step transient.

When coding the signal includes the LTP for the complete signal (because the LTP decision is based only on the pitch gain), the spectrogram of the output looks as presented in FIG. 14.

Figure 15:
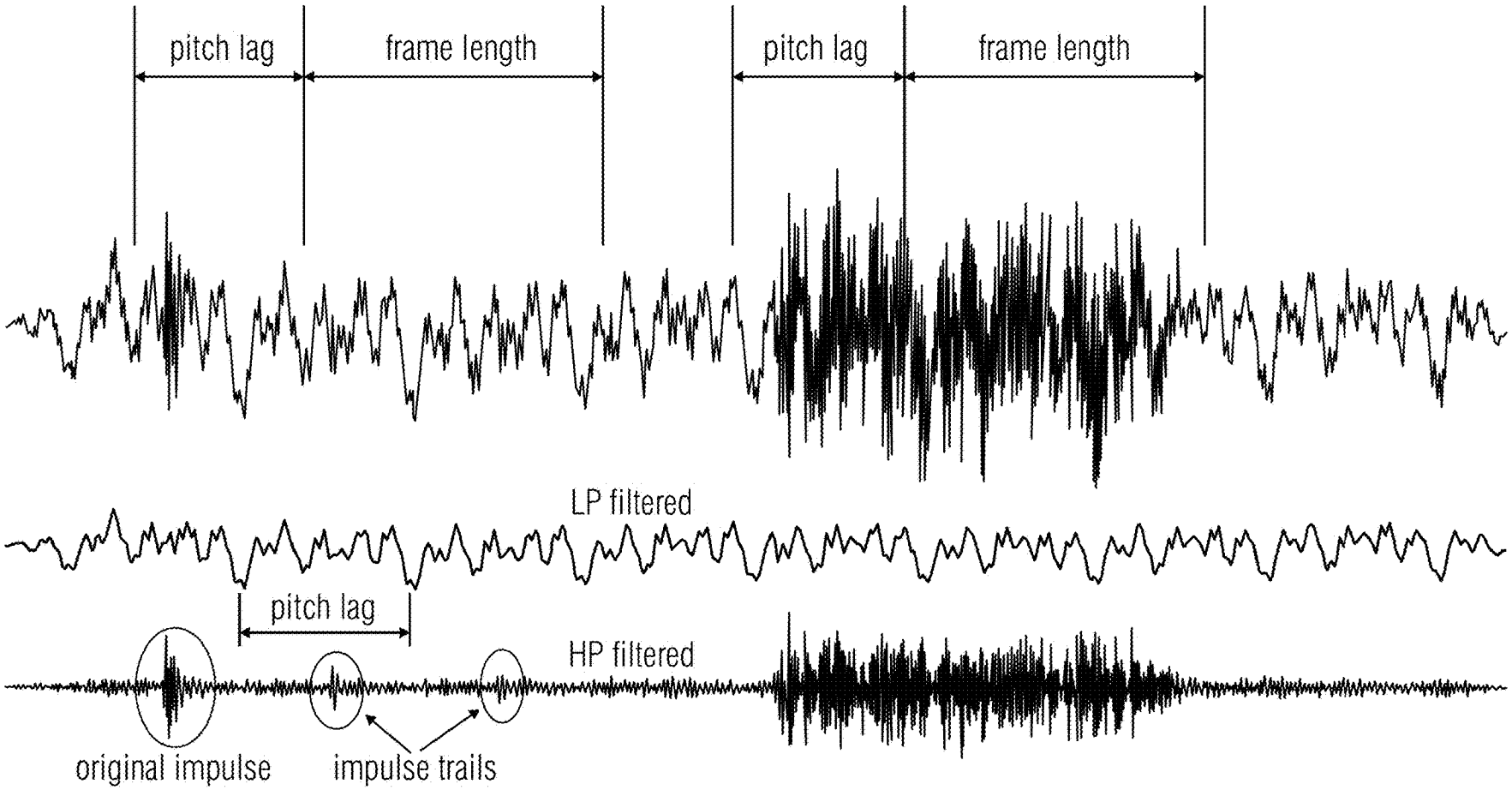
FIG. 15 shows, one upon the other, time-domain portions of the audio signal shown in FIG. 14, and its low pass filtered and high-pass filtered version thereof, respectively, in order to illustrate the control according to FIGS. 2, 3, 16 and 17 for impulse and for step transient.

The waveform of the signal, which spectrogram is in FIG. 14, is presented in FIG. 15. The FIG. 15 also includes the same signal Low-pass (LP) filtered and High-pass (HP) filtered. In the LP filtered signal the harmonic structure becomes clearer and in the HP filtered signal the location of the impulse like transient and its trail is more evident. The level of the complete signal, LP signal and HP signal is modified in the figure for the sake of the presentation.

For short impulse like transients (as the first transient in FIG. 13), the long term prediction produces repetitions of the transient as can be seen in FIG. 14 and FIG. 15. Using the long term prediction during the step like long transients (as the second transient in FIG. 13) doesn't introduce any additional distortions as the transient is strong enough for longer period and thus masks (simultaneous and post-masking) the portions of the signal constructed using the long term prediction. The decision mechanism enables the LTP for step like transients (to exploit the benefit of prediction) and disables the LTP for short impulse like transient (to prevent artifacts).

Figure 16:
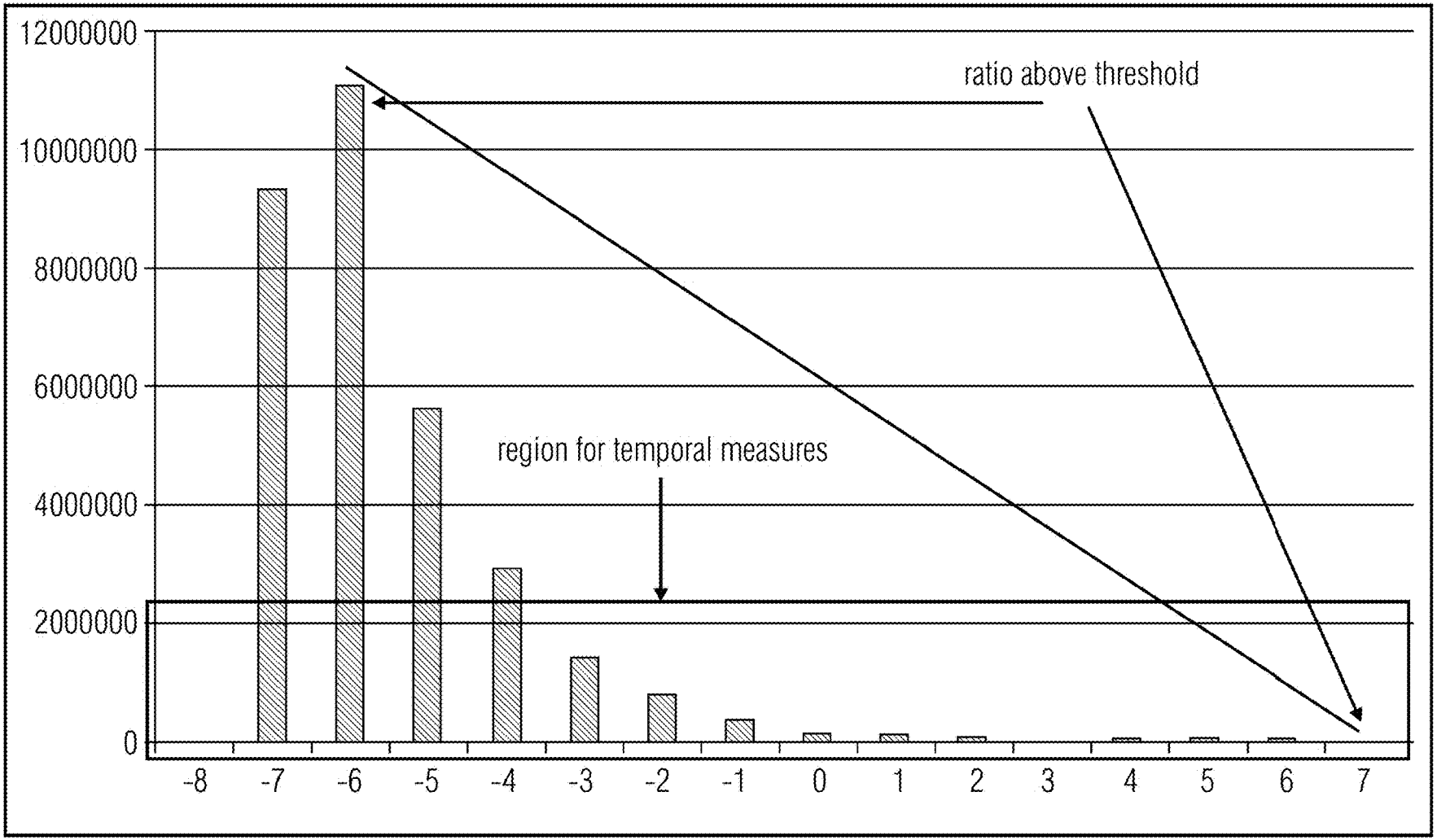
FIG. 16 shows a bar chart of an example for temporal sequence of energies of segments—sequence of energy samples—for an impulse like transient and the placement of the temporal region for determining the at least one temporal structure measure in accordance with FIGS. 2 and 3.
Figure 17:
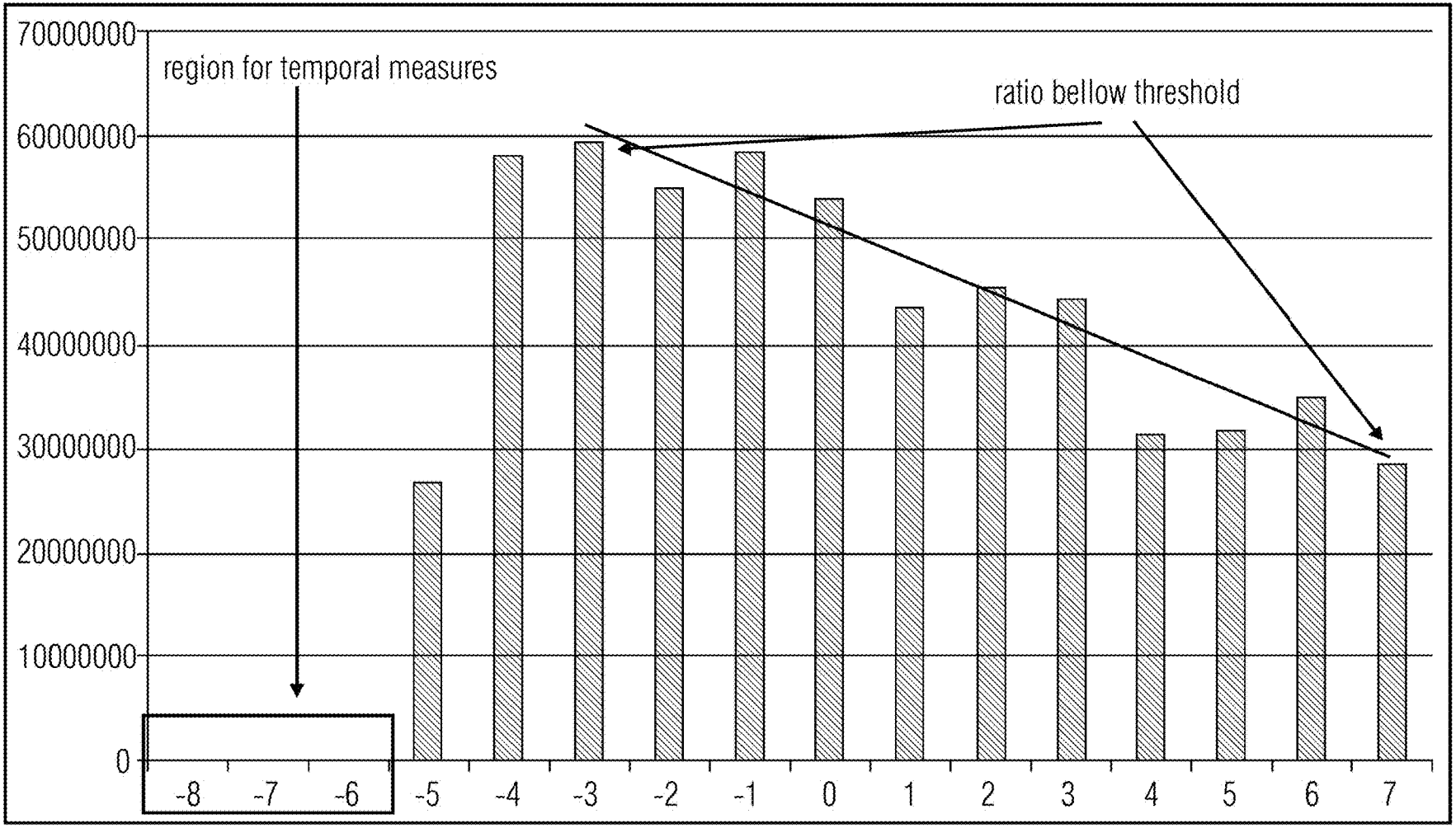
FIG. 17 shows a bar chart of an example for temporal sequence of energies of segments—sequence of energy samples—for a step like transient and the placement of the temporal region for determining the at least one temporal structure measure in accordance with FIGS. 2 and 3.

In FIG. 16 and FIG. 17, the energies of segments computed in transient detector are shown. FIG. 16 shows impulse like transient FIG. 17 shows step like transient. For impulse like transient in FIG. 16 the temporal features are calculated on the signal containing the current frame ($N_{new}$ segments) and the past frame up to the pitch lag ($N_{past}$ segments), since the ratio $$\frac{E_{TD}(i_{max})}{E_{TD}(i_{min})}$$

is above the threshold (1/0.375). For the step like transient in FIG. 17, the ratio $$\frac{E_{TD}(i_{max})}{E_{TD}(i_{min})}$$

is below the threshold (1/0.375) and thus only the energies from segments −8, −7 and −6 are used in the calculation of the temporal measures. These different choices of the segments where the temporal measures are calculated, leads to determination of much higher energy fluctuations for impulse like transients and thus to disabling the LTP for impulse like transients and enabling the LTP for step like transients.

Example 3

Figure 18:
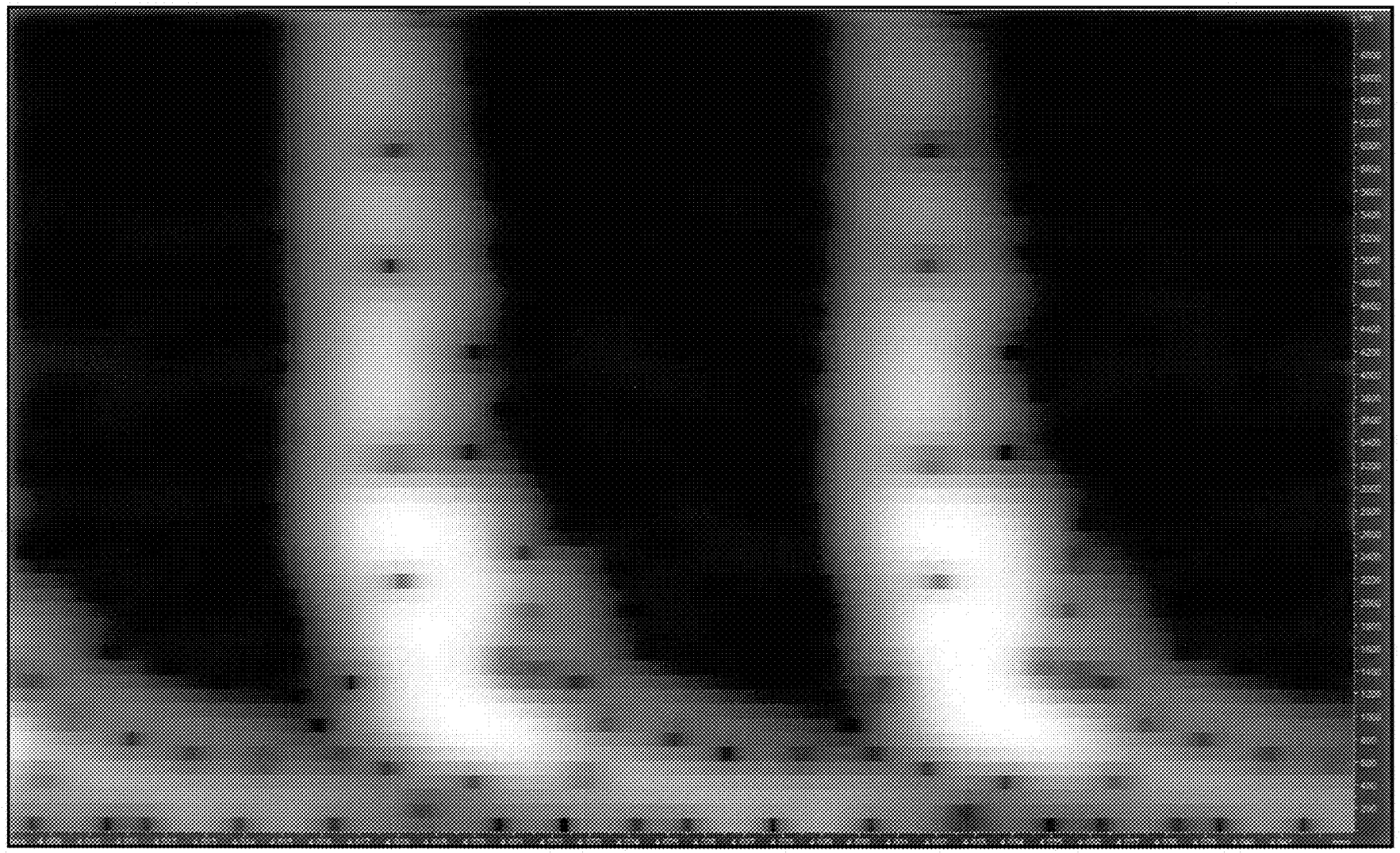
FIG. 18 shows an exemplary spectrogram of a train of pulses (excerpt using short FFT spectrogram)
Figure 19:
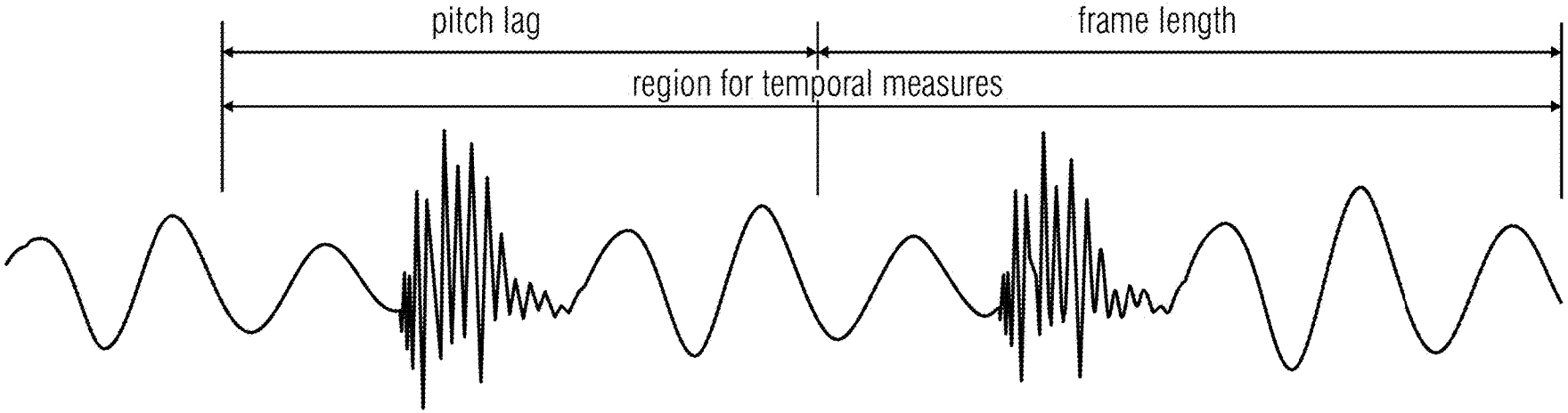
FIG. 19 shows an exemplary waveform of the train of pulses.

However in some cases the usage of the temporal measures may be disadvantageous. The spectrogram in FIG. 18 and the waveform in FIG. 19 display an excerpt of about 35 milliseconds from the beginning of "Kalifornia" by Fatboy Slim.

The LTP decision that is dependent on the Temporal Flatness Measure and on the Maximum Energy Change disables the LTP for this type of signal as it detects huge temporal fluctuations of energy.

This sample is an example of ambiguity between transients and train of pulses that form low pitched signal.

Figure 20:
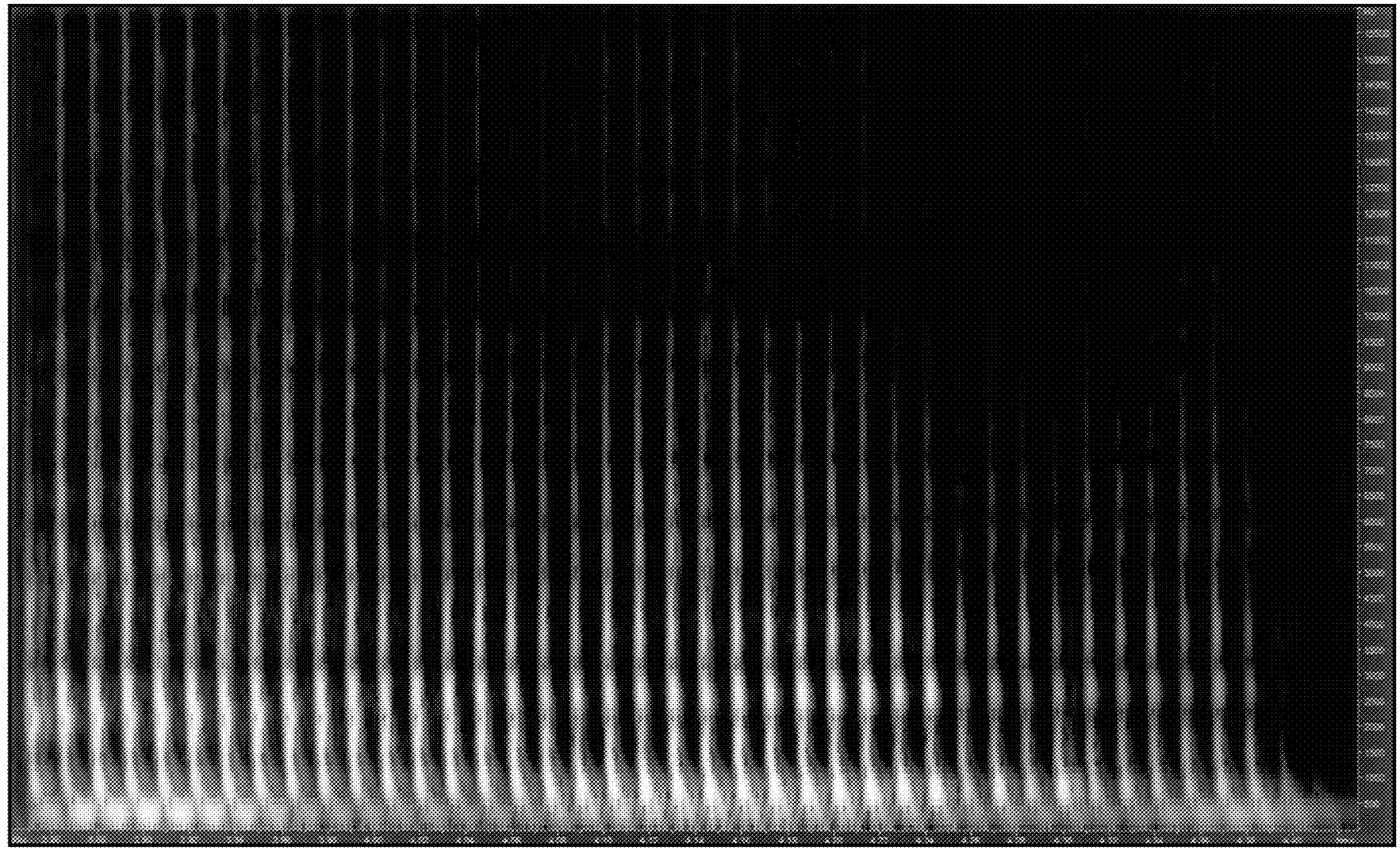
FIG. 20 shows an original Short FFT spectrogram of the train of pulses.

As can be seen in FIG. 20, where the 600 milliseconds excerpt from the same signal the signal is presented, the signal contains repeated very short impulse like transient (the spectrogram is produced using short length FFT).

Figure 21:
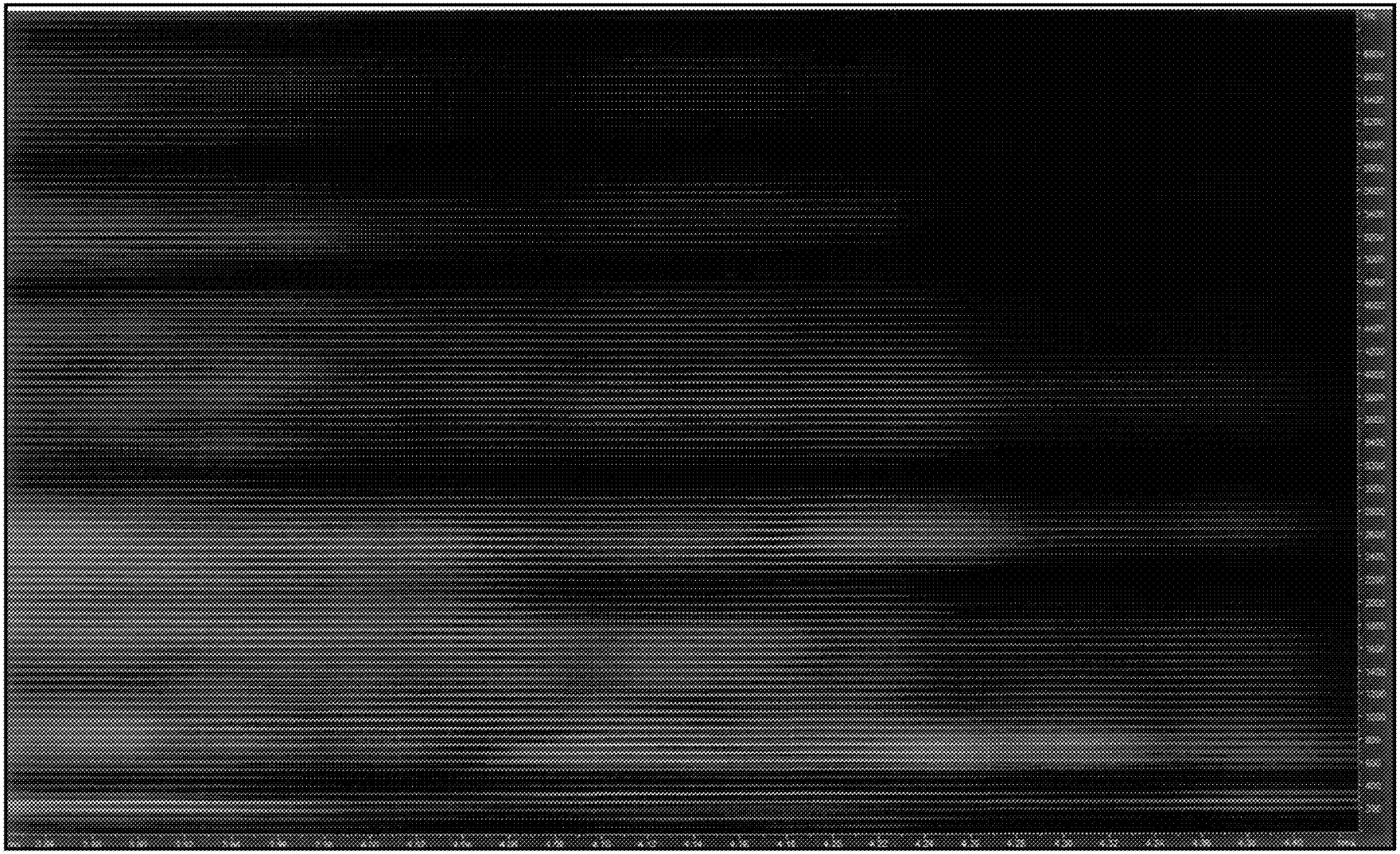
FIG. 21 shows an original Long FFT spectrogram of the train of pulses.

As can be seen in the same 600 milliseconds excerpt in FIG. 21 the signal looks as if it contains very harmonic signal with low and changing pitch (the spectrogram is produced using long length FFT).

This kind of signals benefit from the LTP as there is clear repetitive structure (equivalent to clear harmonic structure). Since there is clear energy fluctuation (that can be seen in FIG. 18, FIG. 19 and FIG. 20), the LTP would be disabled due to exceeding threshold for the Temporal Flatness Measure or for the Maximum Energy Change. However, in our proposal, the LTP is enabled due to the normalized correlation exceeding the threshold dependent on the pitch lag (norm_corr(curr)<=$1.2-T_{int}/L$).

Thus, above embodiments, inter alias, revealed, for example, a concept for a better harmonic filter decision for audio coding. It has to be restated in passing that slight deviations from said concept are feasible. In particular, as noted above, the audio signal 12 may be a speech or music signal and may be replaced by a pre-processed version of signal 12 for the purpose of pitch estimation, harmonicity measurement, or temporal structure analysis or measurement. Also, the pitch estimation may not be limited to measurements of pitch lags but, as should be known to those skilled in the art, may also be performed via measurements of a fundamental frequency, in the time or a spectral domain, which can easily be converted into an equivalent pitch lag by way of an equation such as "pitch lag=sampling frequency/pitch frequency". Thus, generally speaking, the pitch estimator 16 estimates the audio signal's pitch which, in turn, is manifests itself in pitch-lag and pitch frequency.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for performing a harmonicity-dependent controlling of a harmonic filter tool of an audio codec, comprising a harmonicity measurer configured to determine a measure of harmonicity of the audio signal, a temporal structure analyzer configured to determine, depending on the pitch, at least one temporal structure measure measuring a characteristic of a temporal structure of the audio signal;

a controller configured to control the harmonic filter tool depending on the temporal structure measure and the measure of harmonicity.

2. The apparatus according to claim 1, wherein the harmonicity measurer is configured to determine the measure of harmonicity by computing a normalized correlation of the audio signal or a pre-modified version thereof at or around a pitch-lag of the audio signal.

3. The apparatus according to claim 1, further comprising a pitch estimator configured to determine a pitch of the audio signal.

4. The apparatus according to claim 3, wherein the pitch estimator is configured to, within a first stage, determine a preliminary estimation of the pitch at a down-sampled domain of a first sample rate and, within a second stage, refine the preliminary estimation of the pitch at a second sample rate, higher than the first sample rate.

5. The apparatus according to claim 3, wherein the pitch estimator is configured to determine the pitch using autocorrelation.

6. The apparatus according to claim 3, wherein the temporal structure analyzer is configured to determine the at least one temporal structure measure within a temporal region temporally placed depending on the pitch.

7. The apparatus according to claim 6, wherein the temporal structure analyzer is configured to position a temporally past-heading end of the temporal region, or of a region of higher influence onto the determination of the temporal structure measure, depending on the pitch.

8. The apparatus according to claim 3, wherein the temporal structure analyzer is configured to position the temporal past-heading end of the temporal region or, of the region of higher influence onto the determination of the temporal structure measure, such that the temporally past-heading end of the temporal region or, of the region of higher influence onto the determination of the temporal structure measure, is displaced into past direction by a temporal amount monotonically increasing with a decrease of the pitch.

9. The apparatus according to claim 7, wherein the temporal structure analyzer is configured to position a temporally future-heading end of the temporal region or, of the region of higher influence onto the determination of the temporal structure measure, depending on the temporal structure of the audio signal within a temporal candidate region extending from the temporally past-heading end of the temporal region, or of the region of higher influence onto the determination of the temporal structure measure, to a temporally future-heading end of a current frame.

10. The apparatus according to claim 9, wherein the temporal structure analyzer is configured to use an amplitude or ratio between maximum and minimum energy samples within the temporal candidate region in order to position the temporally future-heading end of the temporal region or, of the region of higher influence onto the determination of the temporal structure measure.

11. The apparatus according to claim 1, wherein the controller comprises a logic configured to check whether a predetermined condition is met by the at least one temporal structure measure and the measure of harmonicity so as to achieve a check result; and a switch configured to switch between enabling and disabling the harmonic filter tool depending on the check result.

12. The apparatus according to claim 11, wherein the at least one temporal structure measure measures an average or maximum energy variation of the audio signal within the temporal region and the logic is configured such that the predetermined condition is met if both the at least one temporal structure measure is smaller than a predetermined first threshold and the measure of harmonicity is, for a current frame and/or a previous frame, above a second threshold.

13. The apparatus according to claim 12, wherein the logic is configured such that the predetermined condition is also met if the measure of harmonicity is, for a current frame, above a third threshold, and the measure of harmonicity is, for a current frame and/or a previous frame, above a fourth threshold which decreases with an increase of a pitch lag of the audio signal.

14. The apparatus according to claim 1, wherein the controller is configured to control the harmonic filter tool by explicitly signaling a control signal via an audio codec's data stream to a decoding side; or explicitly signaling a control signal via an audio codec's data stream to a decoding side for controlling a post-filter at the decoding side and, in line with the control of the post-filter at the decoding side, controlling a pre-filter at an encoder side.

15. The apparatus according to claim 1, wherein the temporal structure analyzer is configured to determine the at least one temporal structure measure in a spectrally discriminating manner so as to acquire one value of the at least one temporal structure measure per spectral band of a plurality of spectral bands.

16. The apparatus according to claim 1, wherein the controller is configured to control the harmonic filter tool at units of frames, and the temporal structure analyzer is configured to sample an energy of the audio signal at a sample rate higher than a frame rate of the frames so as to acquire energy samples of the audio signal and to determine the at least one temporal structure measure on the basis of the energy samples.

17. The apparatus according to claim 16, wherein the temporal structure analyzer is configured to determine the at least one temporal structure measure within a temporal region temporally placed depending on a pitch of the audio signal and the temporal structure analyzer is configured to determine the at least one temporal structure measure on the basis of the energy samples by computing a set of energy change values measuring a change between pairs of immediately consecutive energy samples of the energy samples within the temporal region and subjecting the set of energy change values to a scalar function comprising a maximum operator or a sum over addends each of which depends on exactly one of the set of energy change values.

18. The apparatus according to claim 16, wherein the temporal spectrum analyzer is configured to perform the sampling of the energy of the audio signal within a high-pass filtered domain.

19. The apparatus according to claim 3, wherein the pitch estimator, the harmonicity measurer and the temporal structure analyzer perform its determination based on different versions of the audio signal comprising the original audio signal and some pre-modified version thereof.

20. The apparatus according to claim 1, wherein the controller is configured to, in controlling the harmonic filter tool, depending on the temporal structure measure and the measure of harmonicity switch between enabling and disabling a pre-filter and/or a post-filter of the harmonic filter tool, or gradually adapt a filter strength of the pre-filter and/or the post-filter of the harmonic filter tool, wherein the harmonic filter tool is of a pre-filter plus post-filter approach and the pre-filter of the harmonic filter tool is configured to increase the quantization noise within a harmonic of a pitch of the audio signal and the post-filter of the harmonic filter tool is configured to reshape a transmitted spectrum accordingly, or the harmonic filter tool is of a post-filter only approach and the post-filter of the harmonic filter tool is configured to filter quantization noise occurring between the harmonics of the pitch of the audio signal.

21. An audio encoder or audio decoder, comprising a harmonic filter tool and the apparatus for performing a harmonicity-dependent controlling of the harmonic filter tool according to claim 1.

22. A system comprising an apparatus for performing a harmonicity-dependent controlling of a harmonic filter tool according to claim 16, and a transient detector configured to detect transients in an audio signal to be processed by the audio codec on the basis of the energy samples.

23. A transform-based encoder comprising the system of claim 22, configured to switch a transform block and/or overlap length depending on the detected transients.

24. An audio encoder comprising the system of claim 22, configured to support switching between a transform coded excitation mode and a code excited linear prediction mode depending on the detected transients.

25. The audio encoder according to claim 24, configured to switch a transform block and/or overlap length in the transform coded excitation mode depending on the detected transients.

26. A method for performing a harmonicity-dependent controlling of a harmonic filter tool of an audio codec, comprising determining a measure of harmonicity of the audio signal;

determining, depending on the pitch, at least one temporal structure measure measuring a characteristic of a temporal structure of the audio signal;

controlling the harmonic filter tool depending on the temporal structure measure and the measure of harmonicity.

27. A non-transitory digital storage medium having a computer program stored thereon to perform a method for performing a harmonicity-dependent controlling of a harmonic filter tool of an audio codec, the method comprising:

determining a measure of harmonicity of the audio signal;

determining, depending on the pitch, at least one temporal structure measure measuring a characteristic of a temporal structure of the audio signal;

controlling the harmonic filter tool depending on the temporal structure measure and the measure of harmonicity;

when said computer program is run by a computer.

* * * * *